US007360854B2

(12) United States Patent
Morisaki

(10) Patent No.: US 7,360,854 B2
(45) Date of Patent: Apr. 22, 2008

(54) INK JET RECORDING APPARATUS

(75) Inventor: Hiroshi Morisaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 191 days.

(21) Appl. No.: 11/277,564

(22) Filed: Mar. 27, 2006

(65) Prior Publication Data

US 2006/0221108 A1 Oct. 5, 2006

(30) Foreign Application Priority Data

Mar. 29, 2005 (JP) ..... 2005-093741

(51) Int. Cl.
*B41J 29/38* (2006.01)

(52) U.S. Cl. ..... 347/14; 347/19; 347/101; 347/104; 347/105

(58) Field of Classification Search ..... 347/14, 347/19, 101, 104, 105
See application file for complete search history.

(56) References Cited

U.S. PATENT DOCUMENTS 6,325,559 B1 * 12/2001 Kaiser et al. ..... 400/624
6,341,905 B1 * 1/2002 Suzuki ..... 400/120.09

FOREIGN PATENT DOCUMENTS

JP 2004082631 A 3/2004

* cited by examiner

*Primary Examiner*—Lamson Nguyen
*Assistant Examiner*—Justin Seo
(74) *Attorney, Agent, or Firm*—Baker Botts L.L.P.

(57) ABSTRACT

An ink jet recording apparatus includes a conveying mechanism configured to sequentially convey recording sheets, and a detector including a light source and a light-receiving element. The detector is configured to detect an edge position of each of the recording sheets. The apparatus also includes an ink jet recording head configured to eject ink droplets on each of the recording sheets, and a scanning carriage configured to move in a main scanning direction orthogonal to the conveying direction. The detector and the ink jet recording head are mounted to the scanning carriage. The apparatus also includes a determining unit for determining one or more characteristics of each of the recording sheets, and a storing unit configured to store the edge position of each of the recording sheets and the one or more characteristics of each of the recording sheets. Moreover, the apparatus includes a controller, and when the edge position of each of the recording sheets is within a predetermined edge position range, the controller is configured to control the ejection of ink droplets on a subsequent recording sheet, which sequentially is conveyed after a last of the recording sheets is conveyed, based on the edge position and the on e or more characteristics of each of the plurality of the recording sheets.

19 Claims, 22 Drawing Sheets

INK JET RECORDING APPARATUS

CROSS REFERENCE TO RELATED APPLICATION

The present application claims priority from Japanese Patent Application No. 2005-093741, filed on Mar. 29, 2005, the disclosure of which is incorporated herein by reference in its entirety.

BACKGROUND OF THE INVENTION

1. Technical Field

The present invention relates generally to an ink jet recording apparatus which detects an edge position of a plurality of recording sheets and determines a size and/or a type of the plurality of recording sheets, and ejects droplets of ink on to a subsequent recording sheet based on the detected edge position and the determined size and/or type of the plurality of recording sheets.

2. Description of Related Art

In an ink jet recording apparatus, ink having different hues, such as yellow, cyan, magenta and black are supplied to a recording bead, and the recording head ejects the ink of the respective colors in accordance with a predetermined system to form dots on a recording medium, such that a color image is formed. Known ink jet recording apparatus may perform image recording using a method generally referred to as "marginless recording." "Marginless recording" is a recording method in which ink is ejected over an entire surface of a recording medium i.e., the ink is ejected up to an outer edge of the recording medium, such that the image recorded is similar to that of a photograph.

When marginless recording is executed, the recording medium needs to be precisely conveyed, such that no margin is formed at the outer periphery thereof. In one known ink jet recording apparatus, a media sensor is mounted on a carriage that holds an ink jet recording head, the media sensor detects a position of both edges of a recording medium each time that an image is recorded on the recording medium by a predetermined feed amount e.g., ¼ inch, and scanning of the carriage is controlled based on the detection of the position of the edges.

However, because the detection of the position of the edges of the recording medium is performed during image recording, the amount of time that it takes to record an image increases. Moreover, in order to accurately detect the position the edges of the recording medium, a scanning speed of the carriage decreases.

SUMMARY OF THE INVENTION

Therefore, a need has arisen for ink jet apparatus that overcome these and other shortcomings of the related art. A technical advantage of the present invention is that initially, ink droplets may be ejected on to recording sheets based on a complex control, however, when predetermined conditions are satisfied with respect a predetermined number of sequential recording sheets, a simplified control may be employed with respect to subsequent recording sheets, thereby increasing recording imaging speed.

According to an embodiment of the present invention, an ink jet apparatus comprises a conveying mechanism configured to sequentially convey a plurality of recording sheets in a predetermined conveying direction, and a detector comprising a light source for irradiating light on a surface of the recording sheet and a light-receiving element for receiving reflected light from the recording sheet. The detector is configured to detect at least one edge position of each of the plurality of recording sheets when the conveying mechanism conveys each of the plurality of recording sheets to a predetermined position. The apparatus also comprises an ink jet recording head configured to eject ink droplets on each of the plurality of recording sheets, and a scanning carnage configured to move in a main scanning direction orthogonal to the conveying direction. The detector and the ink jet recording head are mounted to the scanning carriage. The apparatus also comprises a determining unit configured to determine at least one characteristic of each of the plurality of recording sheets, and a storing unit configured to store the at least once edge position of each of the plurality of recording sheets and the at least one characteristic of each of the plurality of recording sheets. An image is recorded on each of the plurality of recording sheets when ink droplets are ejected from the ink jet recording head while the conveying mechanism conveys the recording sheets and the scanning carriage moves in the main scanning direction. Moreover, the apparatus comprises a controller, and when at least one predetermined condition associated with the plurality of recording sheets is satisfied, the controller is configured to control the ejection of ink droplets on a subsequent recording sheet, which sequentially is conveyed after a last of the plurality of recording sheets is conveyed, based on the at least one edge position of each of the plurality recording sheets and the at least one characteristic of each of the plurality of the recording sheets.

Other features and advantages of the present invention will be apparent to persons of ordinary skill in the art in view of the following detailed description of the invention and the accompanying drawings.

BRIEF DESCRIPTION OF THE DRAWINGS

For a more complete understanding of the present invention, the needs satisfied thereby, and the features and advantages thereof, reference now is made to the following descriptions taken in connection with the accompanying drawings.

DETAILED DESCRIPTION OF EMBODIMENTS

Embodiments of the present invention and their features and advantages may be understood by referring to FIGS. 1-16B, like numerals being used for like corresponding parts in the various drawings.

Figure 1:
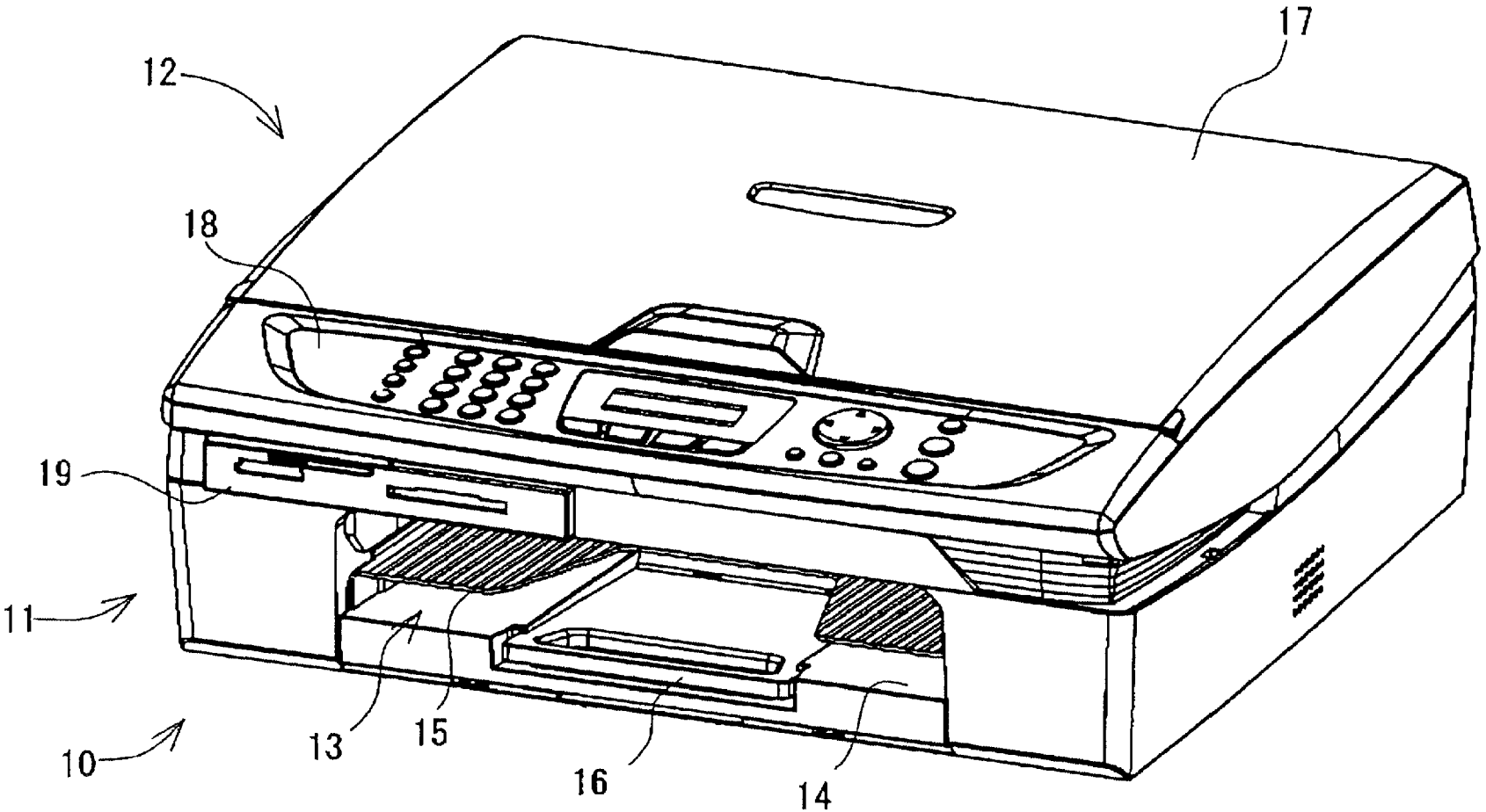
FIG. 1 is an external, perspective view of a complex machine according to a first embodiment of the present invention.

Referring to FIG. 1, a complex machine 10, e.g., a Multi Function Device (MFD), such as an ink jet recording apparatus, may comprise a printer unit 11 in a lower portion thereof and a scanner unit 12 in an upper portion thereof. The complex machine 10 may have a printer function, a scanner function, and a copy function. The printer unit 11 may correspond to an ink jet recording apparatus according to an embodiment of the present invention. Moreover, the present invention may be applied to a single-function printer, e.g., a printer that does not include the scanner function and/or the copy function, and further may be applied to a printer that comprises a communication unit and has a facsimile function, or the like.

When the invention is applied to an ink jet recording apparatus, which is a type of complex machine, the ink jet recording apparatus may be a small apparatus, such as a complex machine 10 according to the first embodiment, or may be a large apparatus comprising a plurality of sheet feeding cassettes and an Auto Document Feeder (ADF). The complex machine 10 may be connected to a computer, and may be configured to record images and documents on recording sheets based on image data and document data transmitted from the computer. Moreover, the complex machine 10 may be connected to a digital camera, and may be configured to record image data outputted from the digital camera on recording sheets, or to record, when various recording media are inserted therein, image data and the like recorded in the recording media on recording sheets.

As shown in FIG. 1, the complex machine may have an external shape of a wide and thin rectangular parallelepiped. A width dimension and a depth dimension of the complex machine 10 may be greater than a height dimension thereof. The printer unit 11 may be disposed in the lower part of the complex machine 10. The printer unit 11 may have an opening 13 formed through the front. A sheet feeding tray 14 and a sheet discharge tray 15 may be disposed in upper and lower two stages in the opening 13 to be exposed. The sheet feeding tray 14 may be a tray for storing recording sheets therein. The sheet feeding tray 14 may be configured to house recording sheets of various sizes smaller than or equal to an A4 size, such as a B5 size or a postcard size. The sheet feeding tray 14 may comprise a slide tray 16. The slide tray 16 may be pulled out as required, whereby a tray surface is enlarged. The recording sheets housed in the sheet feeding tray 14 may be fed inside the printer unit 11 to have a predetermined image recorded thereon, and may be discharged to the sheet discharge tray 15.

The scanner unit 12 may be disposed in the upper part of the complex machine 10. The scanner unit 12 may be a so-called flat-bed scanner. The complex machine 10 may comprise an original cover 17. The original cover 17 may be disposed on the complex machine 10 to freely open and close, and may comprise a top plate of the complex machine 10. A platen glass (not shown) and an image reading carriage (not shown) may be disposed below the original cover 17. The platen glass may be a glass for placing an original thereon. The image reading carriage may be disposed under the platen glass, and may be slidable in a main scanning direction, e.g., a width direction of the complex machine 10. The image reading carriage scans an original by sliding in the width direction of the complex machine 10.

An operation panel 18 may be disposed in the front upper portion of the complex machine 10. The operation panel 18 may be configured to operate the printer unit 11 and the scanner unit 12. The operation panel 18 may comprise various operation buttons and a liquid crystal display section. The complex machine 10 generally operates according to an operation instruction from the operation panel 18 or according to an instruction transmitted from the computer via a printer driver. The operation panel 18 and the printer driver may function as, for example, an inputting unit that inputs a size of recording sheets, e.g., a post card size, an A4 size, or the like. A slot section 19 may be disposed in the left upper portion in the front of the complex machine 10. Various small memory cards serving as recording media may be inserted into the slot section 19. Image data recorded in a small memory card may be displayed on the liquid crystal display section. When the operation panel 18 is operated, an arbitrary image recorded in the small memory card may be recorded on the recording sheets by the printer unit 11.

Figure 2:
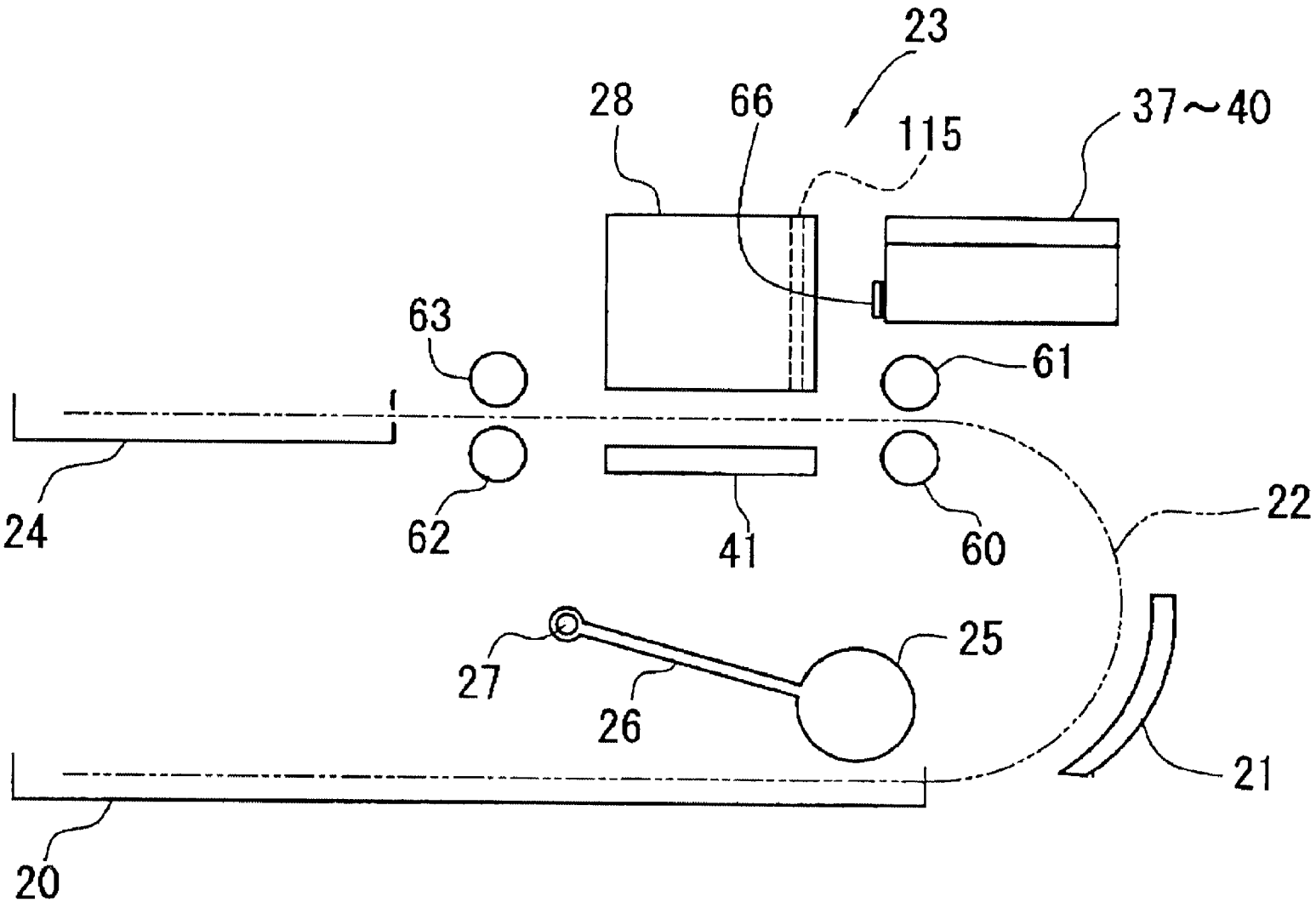
FIG. 2 is a schematic diagram of a printer unit of the complex machine according to the first embodiment of the present invention.

FIG. 2 is a diagram showing the printer unit 11 of the complex machine 10. In FIG. 2, a direction perpendicular to the paper surface is the width direction of the complex machine 10 and is the main scanning direction.

A sheet feeding tray 20 may be disposed at the bottom of the complex machine 10. A separating tilted plate 21 for separating recording sheets stacked on the sheet feeding tray 20 and for guiding the recording sheets upward may be disposed on the inner side (the right side in the figure) of the sheet feeding tray 20. A conveying path 22 may be formed upward from the separating tilted plate 21. The conveying path 22 extends upward, and then curves to the left to extend from the rear side to the front side of the complex machine 10. Moreover, the conveying path 22 passes through an image recording unit 23 to lead to a sheet discharge tray 24. Therefore, the recording sheet housed in the sheet feeding tray 20 may be guided to make a V-turn upward from the bottom by the conveying path 22 and leads to the image recording unit 23. After the image recording unit 23 applies image recording to the recording sheet, the recording sheet is discharged to the sheet discharge tray 24. A direction along the conveying path 22 is a conveying direction of the recording sheet. The conveying direction and the main scanning direction may be orthogonal to each other.

A sheet feeding roller 25 (conveying mechanism) may be disposed above the sheet feeding tray 20. The sheet feeding roller 25 separates the recording sheets stacked on the sheet feeding tray 20 one by one and feeds the recording sheets to the conveying path 22. For example, the sheet feeding roller 25 may be pivotally supported at a tip of a sheet feeding arm 26 that moves up and down to be configured to contact and to separate from the sheet feeding tray 20. The sheet feeding roller 25 may be coupled to a motor via a drive transmitting mechanism. The drive transmitting mechanism may comprise a plurality of gears configured to engage each other. When the motor operates, a driving force of the motor may be transmitted to the sheet feeding roller 25 and the sheet feeding roller 25 rotates.

The sheet feeding arm 26 may be rotatable around a base end shaft 27. Consequently, the sheet feeding arm 26 may be configured to swing in the up-down direction with the base end shaft 27 as a swing center. The sheet feeding arm 26 may be flipped up by a sheet feeding clutch, spring, or the like (not shown) in a standby state and may be swung downward when the recording sheet is fed. When the sheet feeding arm 26 swings downward, the sheet feeding roller 25 pivotally supported at the tip of the sheet feeding arm 26 comes into contact with the surface of the recording sheets on the sheet feeding tray 20. In that state, the sheet feeding roller 25 rotates. A fictional force between a roller surface of the sheet feeding roller 25 and the recording sheets feeds a recording sheet in the uppermost position to the separating tilted plate 21. The fed recording sheet contacts the separating tilted plate 21 at a leading edge thereof to be guided upward and is sent into the conveying path 22. When the recording sheet at the uppermost position is fed by the sheet feeding roller 25, a recording sheet right under the recording sheet may be fed by an action of fiction or static electricity together with the recording sheet However, the recording sheet is stopped by contacting the separating tilted plate 21.

In places other than a place where the image recording unit 23 and the like are disposed, the conveying path 22 may be partitioned by an outer side guide surface and an inner side guide surface opposed at a predetermined interval. In the complex machine 10, the outer side guide surface may comprise an inner wall surface of a frame of the complex machine 10. The inner guide surface may comprise a surface of a guide member provided in the frame of the complex machine 10. In particular, in a place where the conveying path 22 is bent, a conveying roller may be disposed. Although the conveying roller is not shown in the figure, the conveying roller may be configured to freely rotate with the width direction of the conveying path 22 (the direction perpendicular to the paper surface in the figure) as a rotation center axis direction. The conveying roller may be attached, such that a roller surface thereof is exposed on the outer side guide surface or the inner side guide surface. When the conveying roller is provided, the recording sheet contacts the guide surface to be smoothly conveyed even in the place where the conveying path 22 is bent.

Figure 3:
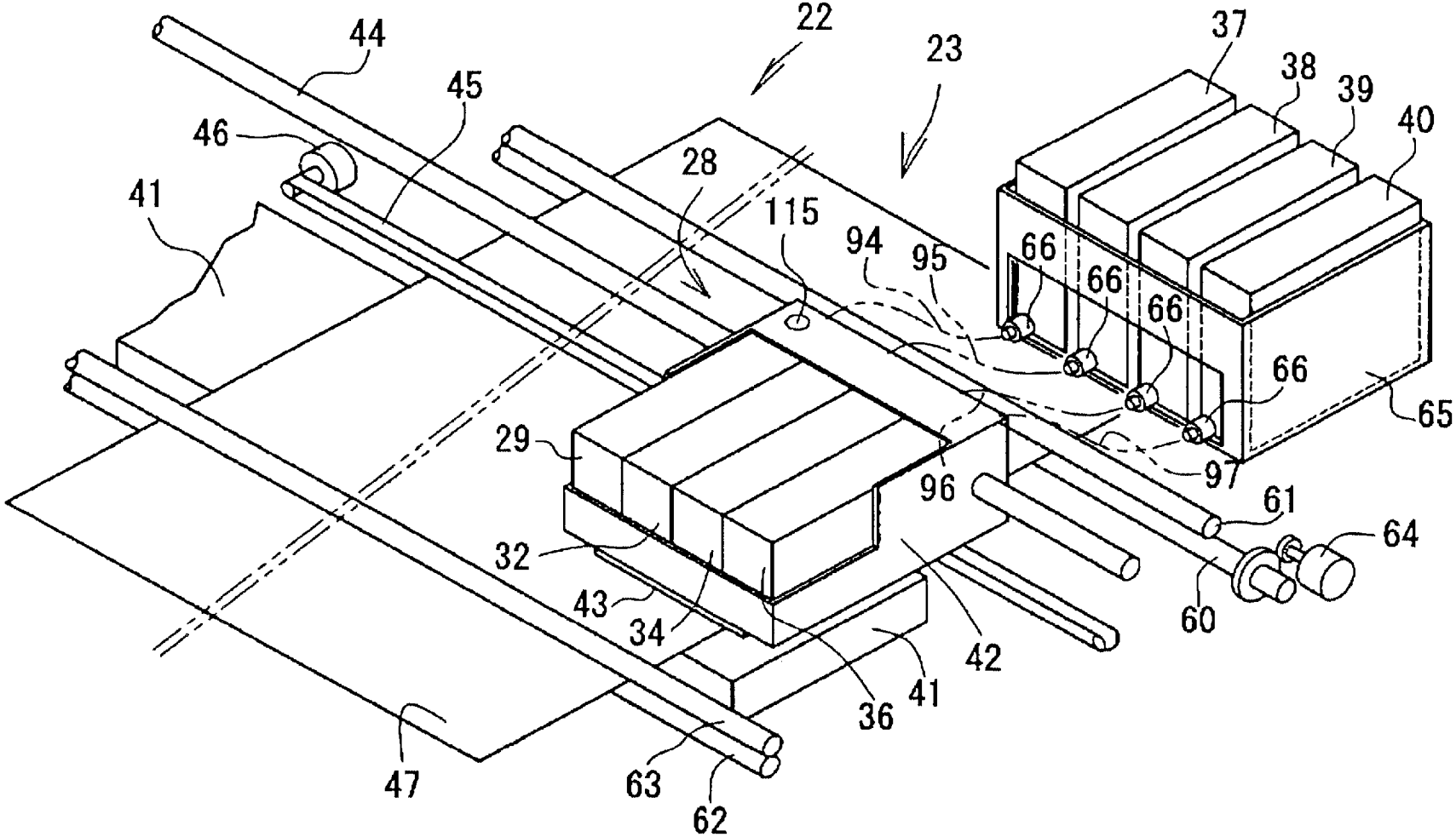
FIG. 3 is a perspective view of an image recording unit of the complex machine according to the first embodiment of the present invention.
Figure 4:
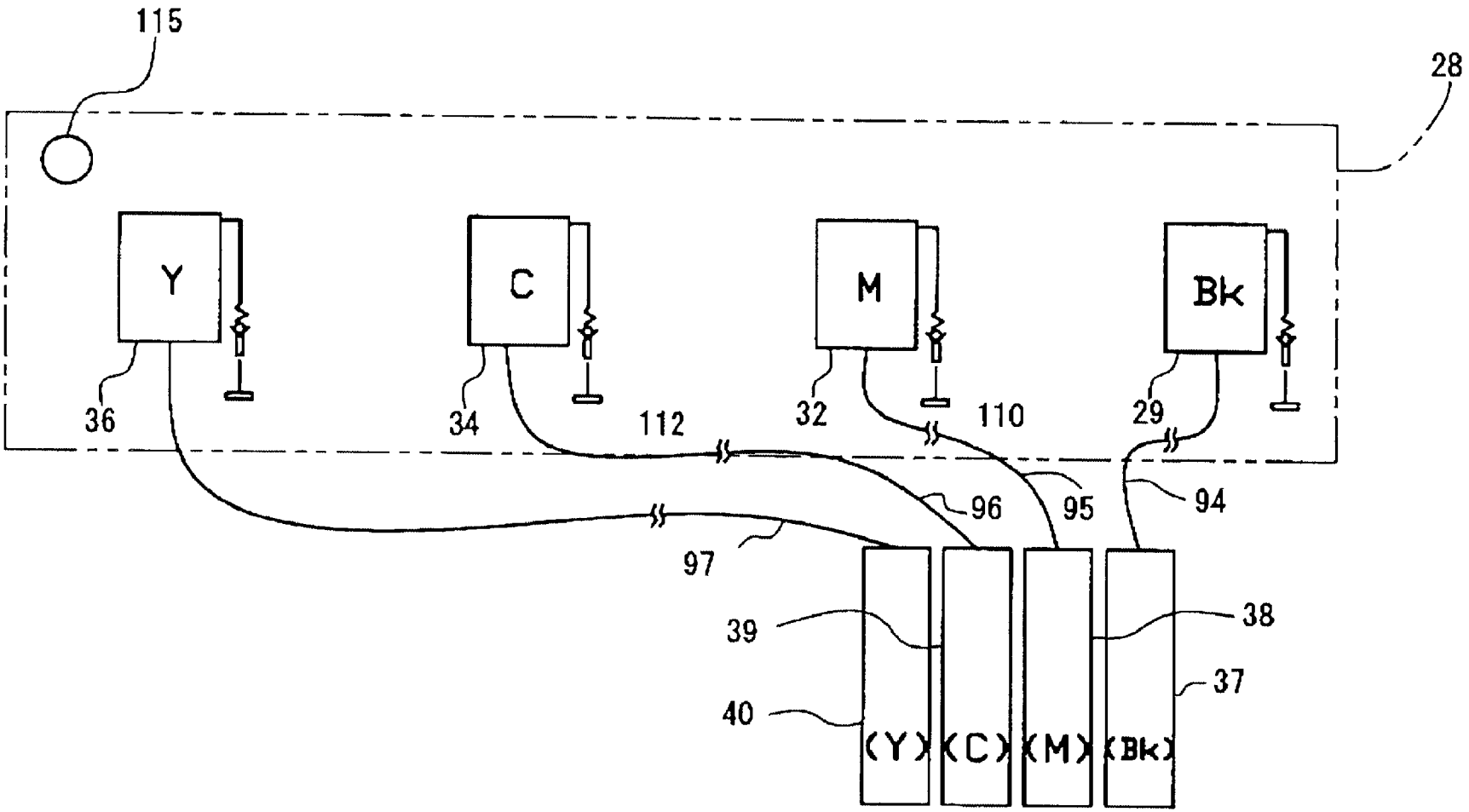
FIG. 4 is a block diagram schematically showing the image recording unit according to the first embodiment of the present invention.

The image recording unit 23 may be disposed on a downstream side after the conveying path 22 makes a V-turn upward from the bottom. FIG. 3 is a perspective view schematically showing the image recording unit 23. FIG. 4 is a block diagram schematically showing the image recording unit 23.

As shown in FIGS. 2 and 3, a driving roller 60 and a pressing roller 61 (conveying mechanism) may be disposed on an upstream side of the image recording unit 23. The driving roller 60 and the pressing roller 61 nip a recording sheet 47 conveyed on the conveying path 22 and send the recording sheet 47 onto a platen 41. On the other hand, a sheet discharge roller 62 and a pressing roller 63 (conveying mechanism) may be disposed on a downstream side of the image recording unit 23. The sheet discharge roller 62 and the pressing roller 63 nip and convey the recording sheet 47 on which an image has been recorded. The driving roller 62 may be driven to rotate by a motor 64. The sheet discharge roller 62 may be driven to rotate by a similar motor. Consequently, the recording sheet 47 is intermittently sent at a predetermined line feed width.

The pressing roller 61 may be elastically urged against the driving roller 60 so as to apply a predetermined amount of force to the driving roller 60. Therefore, when the recording sheet 47 enters between the driving roller 60 and the pressing roller 61, the pressing roller 61 cooperates with the driving roller 60 to nip the recording sheet 47 while elastically retracting by a thickness of the recording sheet 47. Therefore, a rotation force of the driving roller 60 is transmitted to the recording sheet 47. The pressing roller 63 may be provided in the same manner with respect to the sheet discharge roller 62. However, because the pressing roller 63 contacts the recording sheet 47 on which an image has been recorded, a roller surface of the pressing roller 63 may be formed in a spur shape so as not to deteriorate the image recorded on the recording sheet 47.

The recording sheet 47 nipped by the driving roller 60 and the pressing roller 61 may be intermittently conveyed on the platen 41 at the predetermined line feed width. A recording head 43 may be slid in the main scanning direction at every line feed and performs image recording from the leading edge side of the recording sheet 47. The recording sheet 47 subjected to the image recording may be nipped by the sheet discharge roller 62 and the pressing roller 63 from the leading edge side thereof. In other words, the recording sheet 47 may be intermittently conveyed at the predetermined line feed width in a state in which the leading edge side thereof is nipped by the sheet discharge roller 62 and the pressing roller 63 and the trailing edge side thereof is nipped by the driving roller 60 and the pressing roller 61. The recording head 43 applies an image to the recording sheet 47. Moreover, when the recording sheet 47 is conveyed, the trailing edge of the recording sheet 47 passes the driving roller 60 and the pressing roller 61. Consequently, the recording sheet 47 is released from the driving roller 60 and the pressing roller 61 and intermittently is conveyed at the predetermined line feed width by the sheet discharge roller 62 and the pressing roller 63. In this case, as described above, the recording head 43 applies the image to the recording sheet 47. After the image is recorded in a predetermined area of the recording sheet 47, the sheet discharge roller 62 is continuously driven to rotate. The recording sheet 47 nipped by the sheet discharge roller 62 and the pressing roller 63 is discharged to the sheet discharge tray 24.

As shown in FIGS. 24, the image recording unit 23 may comprise a head unit 28, the platen 41 disposed to oppose the head unit 28, a plurality of sub-tanks 29 to 36 that supply ink to the recording head 43 (the ink jet recording head), ink tanks 37 to 40, e.g., of a cartridge type, that supply the ink to the sub-tanks 29 to 36, a pump (not shown) that draws the ink from the respective ink tanks 37 to 40, and a control device (not shown) that controls driving the pump.

The image recording unit 23 applies the image to the recording sheet 47 conveyed on the platen 41. The head unit 28 is slid in the main scanning direction while ejecting respective color ink of black (Bk), magenta (M), cyan (C), and yellow (Y) supplied from the ink tanks 37 to 40, whereby an image is recorded on the recording sheet 47.

Connecting pipes 94 to 97 comprising flexible tubes may be coupled to the respective ink tanks 37 to 40. The head unit 28 may be slid in the left to right direction in FIG. 4. The connecting pipes 94 to 97 have flexibility and are set to a sufficient length. Therefore, the connecting pipes 94 to 97 may transform to smoothly follow the slide of the head unit 28.

As shown in FIG. 3, the head unit 28 may comprise a scanning carriage 42. The sub-tanks 29 to 36 may be held by the scanning carriage 42, and the head unit 28 may comprise the recording head 43. The recording head 43 also may be held by the scanning carriage 42. The recording head 43 may be disposed on a lower surface of the scanning carriage 42 to be exposed, and ink may be supplied from the sub-tanks 29 to 36 to the recording head 43. The scanning carriage 42 may be supported by a guide shaft 44 and may slide along the guide shaft 44. An endless belt 45 may be attached to the scanning carriage 42, and a belt driving motor 46 may be coupled to the endless belt 45 via a pulley. When the belt driving motor 46 operates, the head unit 28 slides in the main scanning direction.

The scanning carriage 42 may comprise a media sensor 115 (detector). The media sensor 115 may be a sensor for detecting presence of the recording sheet 47 and edge positions thereof and may comprise a light source and a light-receiving element. The light source may emit light downward. Light emitted from the light source may be irradiated on the surface of the recording sheet 47 conveyed to the head unit 28 side. When the recording sheet 47 has not been conveyed to above the platen 41, the light is irradiated on the platen 41. The light irradiated on the recording sheet 47 or the platen 41 is reflected and the light-receiving element receives the reflected light and outputs the reflected light according to a light-receiving amount. A value of the output may be represented by a so-called AD value (a voltage value). When the scanning carriage 42 is slid as described above, the media sensor 115 scans the surface of the platen 41. According to a change in the AD value, presence of the recording sheet 47 on the platen 41 and positions of edges of the recording sheet 47 are detected. A control device 69 judges a type (a sheet 24 type) of the recording sheet 47 according to the AD value.

The complex machine 10 according to this embodiment may be generally characterized in that the recording sheet 47 is subjected to sensing and may be conveyed based on information such as edge positions of the recording sheet 47 detected by the media sensor 115, a sheet type of the recording sheet 47 judged as described later, a sheet size of the recording sheet 47 inputted by the operation panel 18, or the like, or any combination thereof, and high-speed and marginless recording may be realized.

Figure 5:
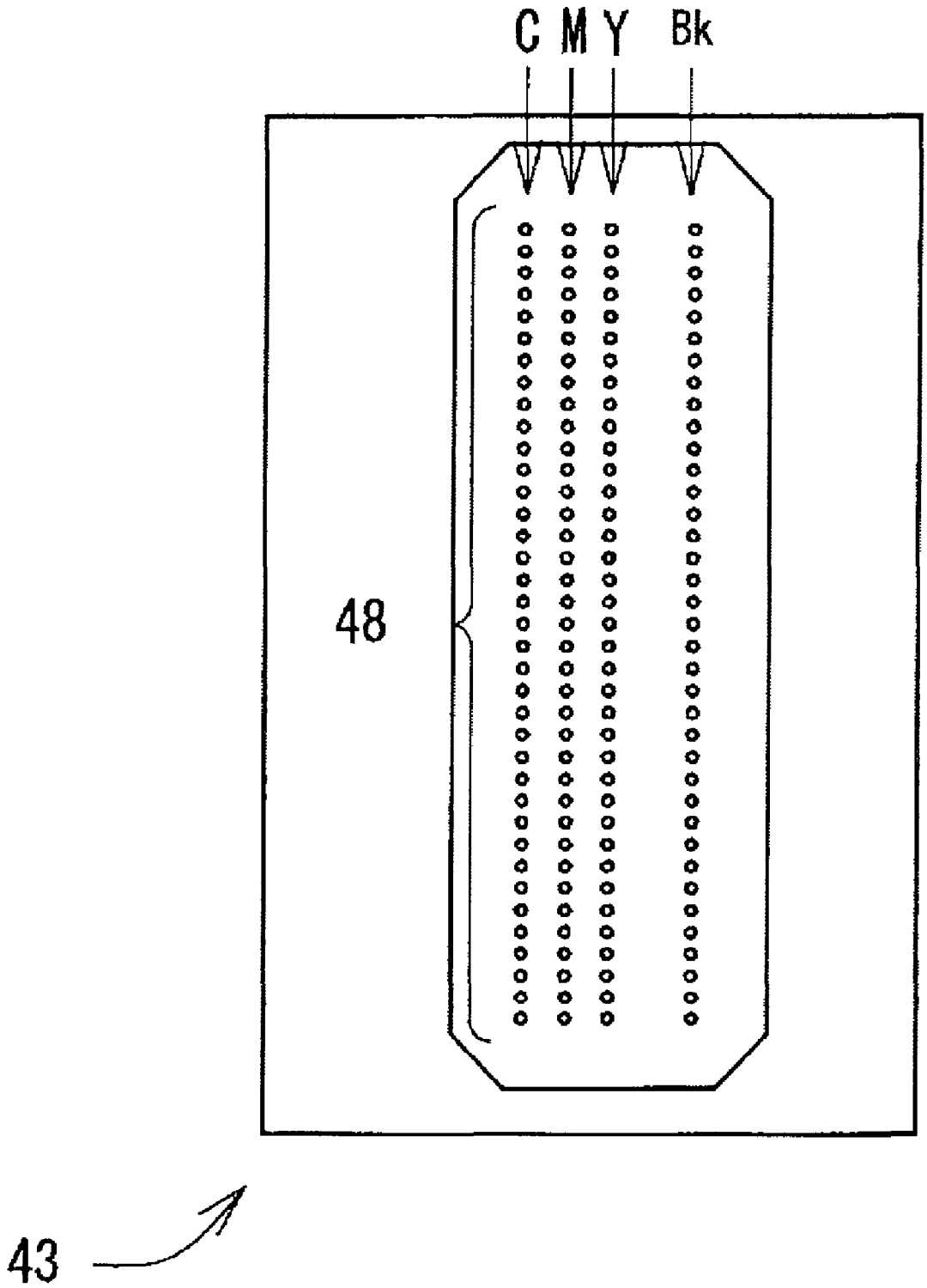
FIG. 5 is an enlarged, bottom view of a recording head of the complex machine according to the first embodiment of the present invention.

FIG. 5 is an enlarged, bottom view of the recording head 43. A lower surface of the recording head 43 is shown in detail.

As shown in FIG. 5, an ink outlet 48 may be disposed on the lower surface of the recording head 43. In this embodiment, nozzles 49 in four rows, which may comprise ink outlet 48, may be provided in parallel in the vertical direction. The vertical direction in the figure is the conveying direction of the recording sheet 47. The nozzles 49 located at the rightmost end in the figure may correspond to a black ink (Bk), such that black ink (the Bk ink) is ejected from these nozzles 49. The nozzles 49 in three rows are provided in order to be adjacent to the nozzles 49 for the Bk ink. The nozzles 49 in the rows may correspond to a yellow ink (Y), a magenta ink (M), and a cyan ink (C), respectively. The yellow ink (the Y ink), the magenta ink (the M ink), and the cyan ink (the C ink) may be ejected from the respective nozzles 49.

Figure 6:
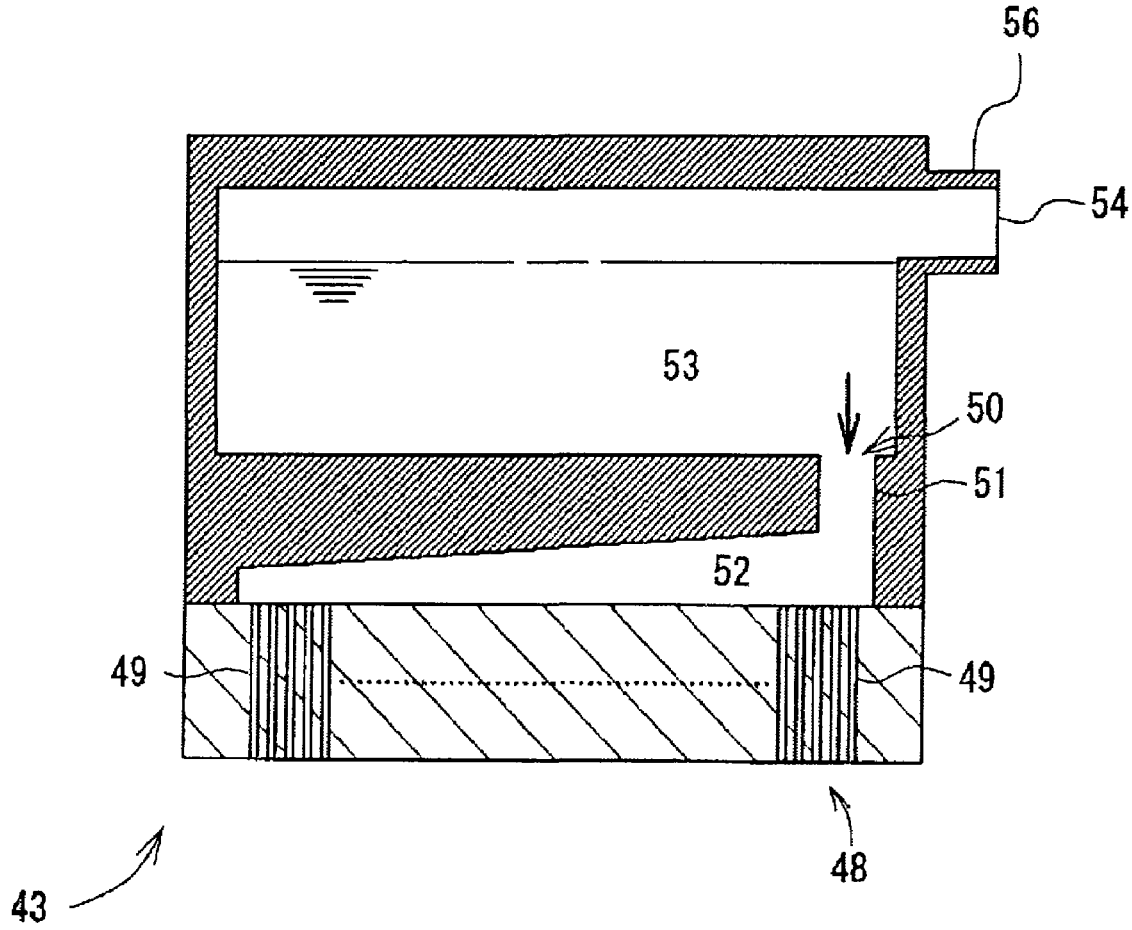
FIG. 6 is a sectional view of a head unit of the complex machine according to the first embodiment of the present invention.

FIG. 6 is a sectional view of the head unit 28.

As shown in FIG. 6, the nozzles 49 may be disposed in the lower part of the recording head 43 for each of the color ink of Bk, Y, M, and C. For the nozzles 49 corresponding to each of the colors of ink, a manifold 50 may be formed on an upstream side of the nozzles 49. The manifold 50 may comprise a supply pipe 51 formed at one end side of the nozzles 49, and a manifold chamber 52 formed continuously to the nozzles 49. An ink supplied from the supply pipe 51 may be distributed to the respective nozzles 49 through the manifold chamber 52.

A surface of the manifold chamber 52 opposed to the nozzles 49 may be tilted to descend toward a downstream side to which the ink flows. A sectional area of the manifold chamber 52 gradually decreases toward the downstream side. As a mechanism with which the nozzles 49 eject the ink distributed by the manifold 50 from the ink outlet 48 as ink droplets, various known mechanisms may be employed. For example, sidewalls of the nozzles 49 may comprise of a piezoelectric material, and a mechanism for ejecting the ink droplets according to deformation of the piezoelectric material may be employed as the mechanism.

A buffer tank 53 may be disposed on the upper side of the manifold 50. The buffer tank 53 may be provided to correspond to each of the color ink in the same manner as the nozzles 49 and the manifold 50. The buffer tank 53 may comprise a portion of or all of the sub-tanks 29 to 36. The ink in the ink tanks 37 to 40 may be supplied to the respective sub-tanks 29 to 36 through an ink supply port 54. In this way, the ink may not be directly supplied to the nozzles 49 from the ink tanks 37 to 40, but instead, may be temporarily stored in the buffer tanks 53 (the sub-tanks 29 to 36). Consequently, air bubbles formed in the ink may be removed and prevented from entering the nozzles 49. The air bubbles captured in the buffer tanks 53 (the sub-tanks 29 to 36) may be discharged from air bubble discharge ports (not shown).

Each of the sub-tanks 29 to 36 (the buffer tanks 53) corresponding to each of the color ink (Bk, Y, M, and C) may comprise a fitting section 56. The ink supply port 54 may be disposed in the fitting section 56. The connecting pipes 94 to 97 comprising flexible tubes may be coupled to the fitting sections 56 (see FIG. 3). Therefore, as shown in FIG. 4, the ink tank 37 and the sub-tank 29 may be connected by the connecting pipe 94, the ink tank 38 and the sub-tank 32 may be connected by the connecting pipe 95, the ink tank 39 and the sub-tank 34 may be connected by the connecting pipe 96, and the ink tank 40 and the sub-tank 36 may be connected by the connecting pipe 97.

As shown in FIG. 3, the ink tanks 37 to 40 may be held by the holder 65. As described above, the ink tanks 37 to 40 store the Bk ink, the M ink, the C ink, and the Y ink, respectively. Connecting sections 66 connected to the fitting sections 56 (see FIG. 6) of the sub-tanks 29 to 36 may be disposed in lower parts of the respective ink tanks 37 to 40, and the connecting pipes 94 to 97 may be coupled to the connecting sections 66.

When the pump operates, the Y ink may be drawn from the ink tank 40 and may be sent to the sub-tank 36 via the connecting pipe 97. Similarly, the C ink may be supplied from the ink tank 39 to the sub-tank 34, the M ink may be supplied from the ink tank 38 to the sub-tank 32, and the Bk ink may be supplied from the ink tank 37 to the sub-tank 29. As described above, the respective sub-tanks 29 to 36 (the buffer tanks 53) communicate with the manifold chambers 52 via the supply pipes 51 (see FIG. 6). Thus, the respective color ink supplied from the ink tanks 37 to 40 flow to the nozzles 49 through the sub-tanks 29 to 36 (the buffer tanks 53) and the manifolds 50. The recording head 43 ejects the respective color ink from the ink outlet 48 as ink droplets.

Figure 7:
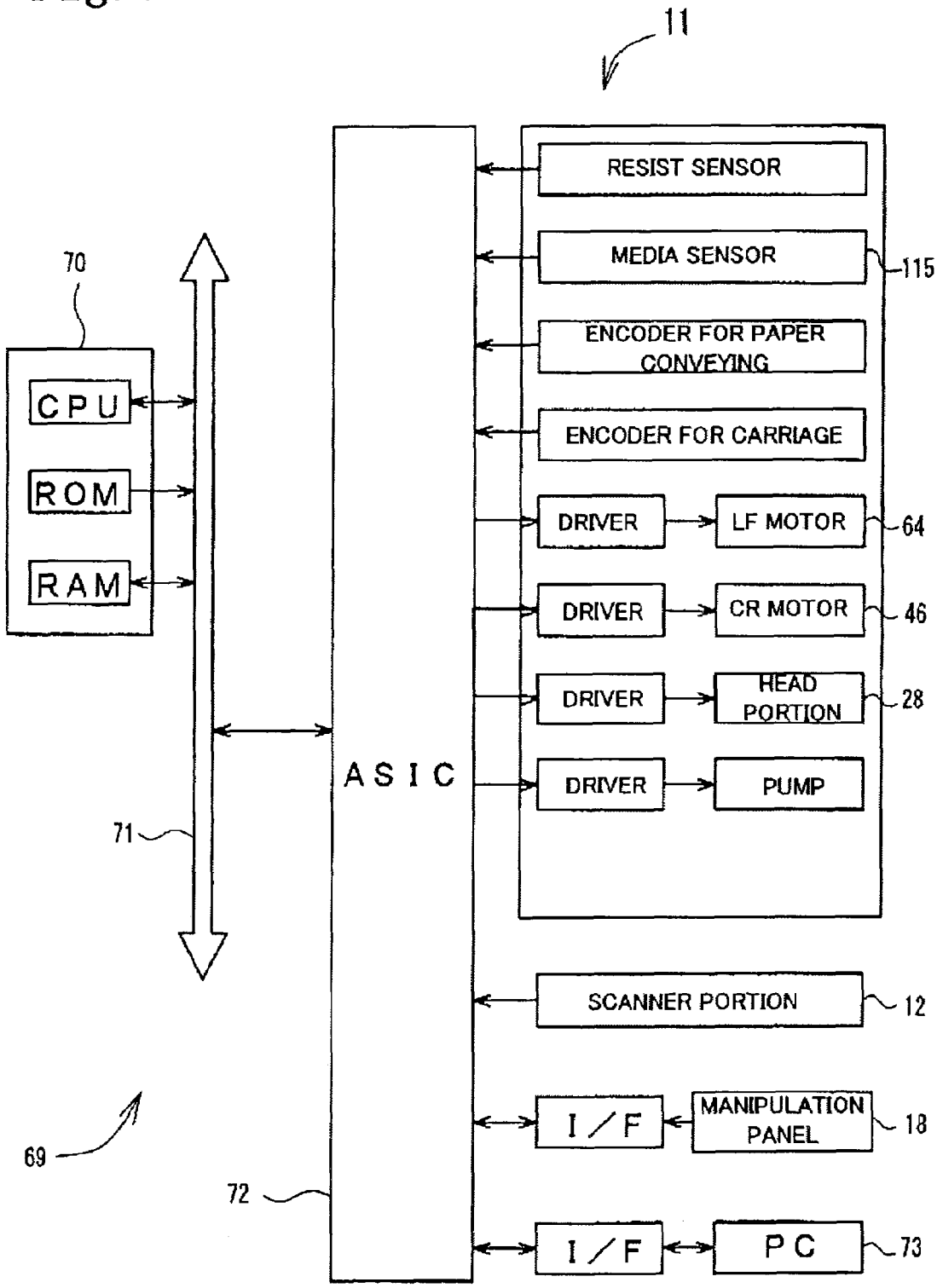
FIG. 7 is a block diagram of a control device of the complex machine according to the first embodiment of the present invention.

FIG. 7 is a block diagram showing the control device of the complex machine 10.

As shown in FIG. 7, the control device 69 may comprise a central processor 70 comprising a CPU (Central Processing Unit), a ROM (Read Only Memory), and a RAM (Random Access Memory). The central processor 70 may be connected to various sensors, the printer unit 11, the saner unit 12, the operation panel 18, and the like via a bus 71 and an ASIC (Application Specific Integrated Circuit) 72.

The ROM of the central processor 70 stores a predetermined computer program. The CPU performs various arithmetic operations on the basis of information of the various sensors in accordance with the computer program. Consequently, rotation control for the motor 64 (an LF motor) serving as a driving source of the driving roller 60, rotation control for the belt driving motor 46 (a CR motor) for sliding the head unit 28, operation control for the pump for drawing ink from the ink tanks 37 to 40, judgment on a sheet type based on information (the AD value) transmitted from the media sensor 115, other predetermined arithmetic operations, and the like may be performed.

The CPU judges a sheet type of the recording sheet 47 in accordance with the computer program stored in the ROM on the basis of the information (the AD value) from the media sensor 115. In other words, the CPU may function as a judging unit that judges a sheet type of the recording sheet 47. Moreover, the CPU detects the presence of the recording sheet 47 on the platen 41 and the edge positions of the recording sheet 47 on the basis of the information (the AD value) from the media sensor 115. For example, a position of one edge in the main scanning direction and a position of the other edge in the main scanning direction of the recording sheet 47 may be detected on the basis of a change in the AD value outputted from the media sensor 115.

The position of one edge in the main scanning direction and the position of the other edge in the main scanning direction of the recording sheet 47 may be detected at a front detection point and an intermediate detection point of the recording sheet 47. The front detection point is a detection point for quantitatively detecting positions of one edge and the other edge of the recording sheet 47 and is a front position in the conveying direction of the recording sheet 47. The intermediate detection point is a detection point set at each predetermined distance, e.g., ¼ inch, backward in the conveying direction with the front detection point as a reference. The CPU determines a skew feed amount of the recording sheet 47 with an arithmetic operation on the basis of the positions of one edge in the main scanning direction and the positions of the other edge in the main scanning direction detected at the front detection point and the plural intermediate detection points.

The positions of one edge in the main scanning direction, the positions of the other edge in the main scanning direction at the respective detection points, the skew feed amount, the sheet types and the sheet size of the recording sheet 47 may be stored in the RAM (storing unit) in association with one another. In other words, sheet type information, sheet size information, edge position information including the position of one edge in the main scanning direction and the position of the other edge in the main scanning direction at the front detection point, the positions of one edge in the main scanning direction and the positions of the other edge in the main scanning direction at the respective intermediate detection points, and the skew feed amount may comprise information associated with the recording sheet 47. The CPU performs control and the like of the head unit 28 on the basis of this information.

The complex machine 10 may be connected to, for example, a personal computer (PC) 73 other than an input from the operation panel 18. The complex machine 10 also may record an image and a document on the recording sheet 47 based on image data and document data transmitted from the computer 73. Therefore, the complex machine 10 also may comprise an interface (I/F) for transmitting data to and for receiving data from the personal computer 73.

Figure 8:
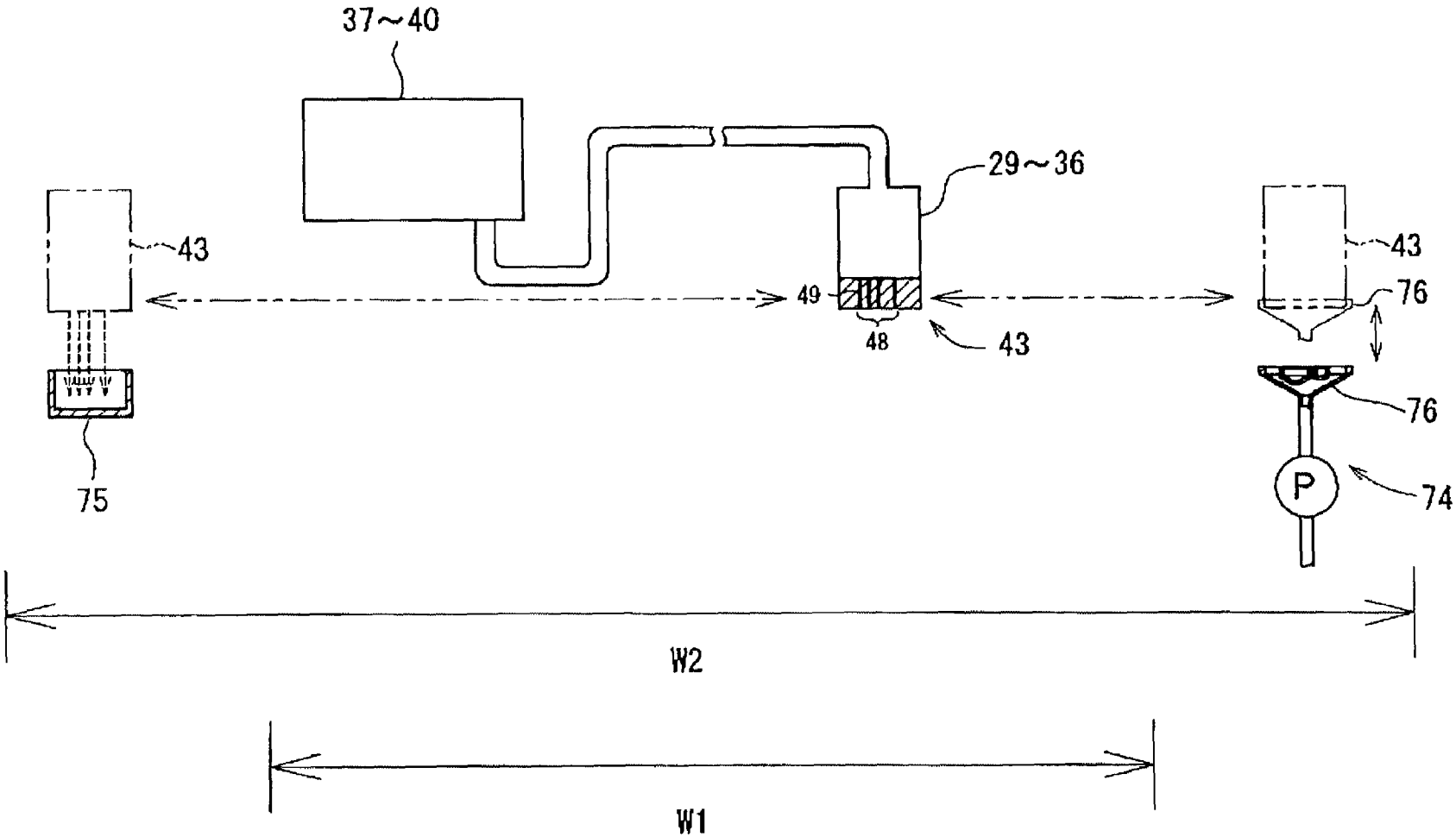
FIG. 8 is a diagram schematically showing an ink supply path and operating positions of the recording head according to the first embodiment of the present invention.

FIG. 8 is a diagram schematically showing an ink supply path through which ink is sent from the ink tanks 37 to 40 to the recording head 43 via the sub-tanks 29 to 36 and operating positions of the recording head 43.

As described above, the ink supplied from the ink tanks 37 to 40 may be stored in the sub-tanks 29 to 36 (the buffer tanks 53) and air bubbles in the ink may be captured. The ink flows from the supply pipes 51 (see FIG. 6) to the manifold chambers 52 to be distributed to the nozzles 49 and are ejected from the respective nozzles 49 as ink droplets. The recording head 43 slides in an image recording range WI while ejecting ink droplets of respective color ink in this way. Consequently, an image may be recorded on the recording sheet 47 conveyed below the recording head 43.

As shown in FIG. 8, a purge mechanism 74 and a waste ink tray 75 may be disposed on both sides of a scannable range W2 on the outside of the image recording range W1 of the recording head 43, respectively. The purge mechanism 74 may be a mechanism for sucking and removing air bubbles and foreign matters from the nozzles 49 and the like of the recording head 43, and may comprise the pump. When the recording head 43 slides to the right end of the scannable range W2, a cap 76 of the purge mechanism 74 moves upward and adheres to the lower surface of the recording head 43 to cover the ink outlet 48. The pump may be connected to the cap 76. When the pump operates, the ink is sucked from the nozzles 49 and the like of the recording head 43 and is sent to the respective sub-tanks 29, 32, 34, and 36. In the complex machine 10 according to this embodiment, the ink tanks 37 to 40 communicate with the outside and pressure in the ink tanks 37 to 40 is the atmospheric pressure. The recording head 43 may be disposed below the ink tanks 37 to 40. Therefore, when the recording head 43 ejects the ink, the ink in the ink tanks 37 to 40, on which the atmospheric pressure acts, may be continuously supplied to the recording head 43 via the connecting pipes 94 to 97 (see FIG. 4). Moreover, the control device 69 performs control of the belt driving motor 46 for sliding the recording head 43, control of the movement of the cap 76, and control of the pump.

The waste ink tray 75 may be a tray for receiving idle ejection of ink from the recording head 43. Such idle ejection of ink is generally called flushing. In the flushing, the recording head 43 is moved to the left end of the scannable range W2 and the respective color ink is idly ejected toward the waste ink tray 75. The arrangement on the left and the right of the purge mechanism 74 and the waste ink tray 75 is not specifically limited. The purge mechanism 74 and the waste ink tray 75 may be disposed on the left and the right oppositely from the arrangement described above in the scannable range W2 or both the purge mechanism 74 and the waste ink tray 75 may be disposed on one of the left and the right.

It is possible to set the holder 65 (see FIG. 3) holding the ink tanks 37 to 40, for example, at the right end of the scannable range W2. Alternatively, the holder 65 may be disposed at the left end of the scannable range W2 or other dead spaces of a frame of the complex machine 10.

Figure 9A:
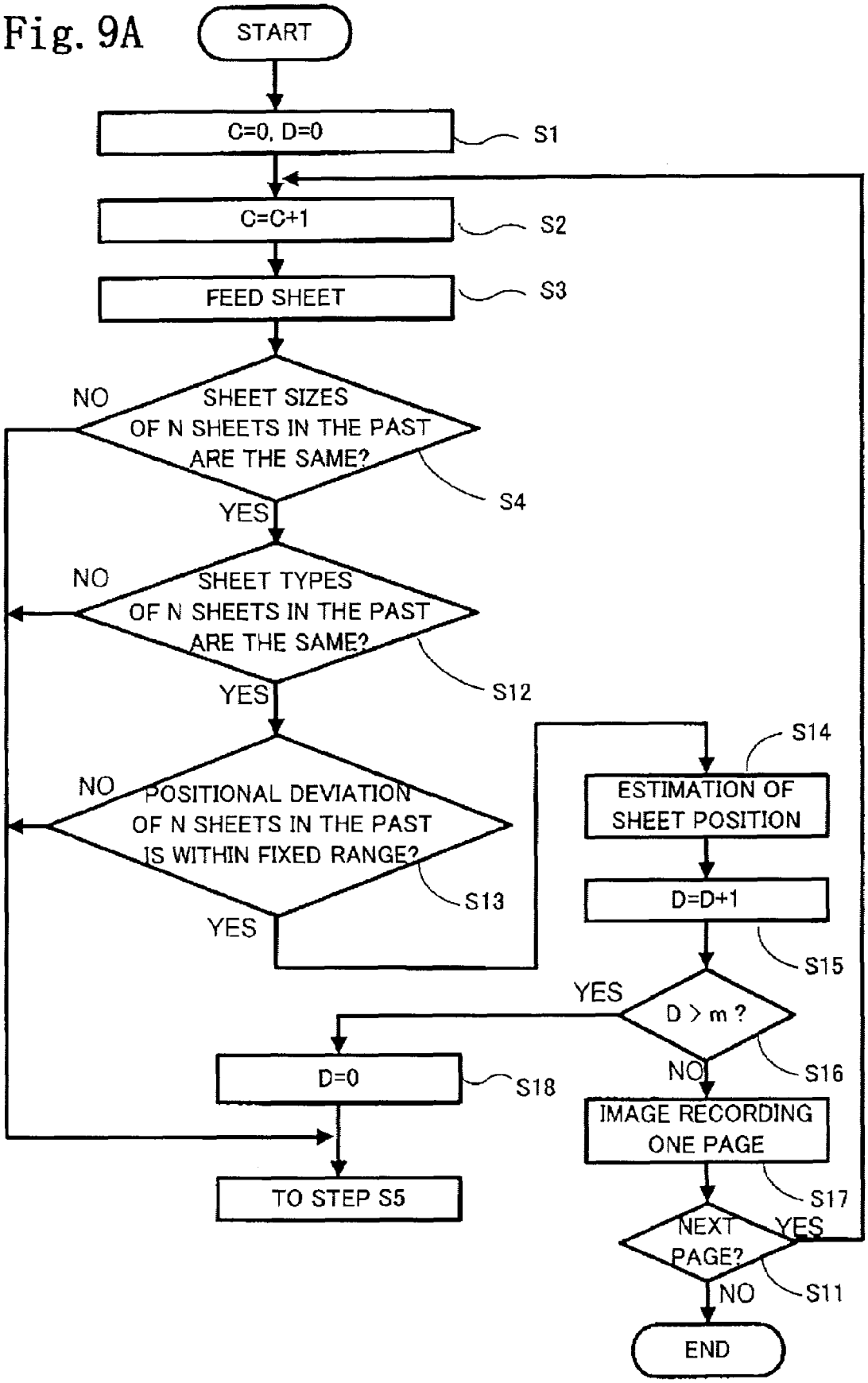
FIGS. 9A and 9B are flowcharts showing a recording procedure by the complex machine according to the first embodiment of the present invention.
Figure 9B:
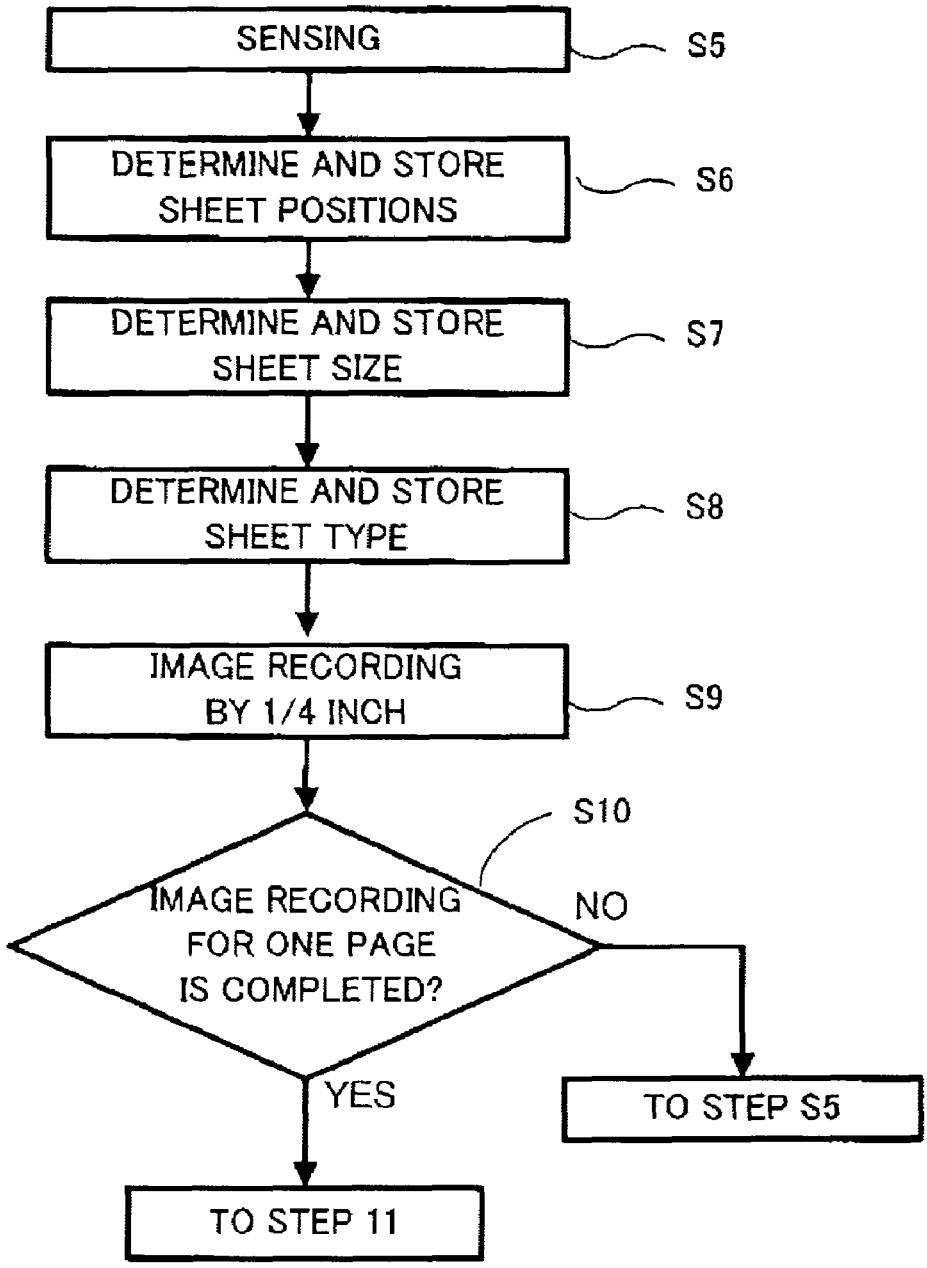

FIGS. 9A and 9B are flowcharts showing a recording procedure by the complex machine 10 according to this embodiment. The complex machine 10 may record an image on the recording sheet 47 according to the following procedure.

When recording is started on the basis of predetermined image data (step S1), a parameter C and a parameter D may be set to initial values (C=D =0). The parameters C and D are counters associated with the recording sheet 47 that is conveyed and to which image recording is applied. The parameter C is a counter of the number of times of recording and the parameter D is a counter of the number of times of a simplified control described later. When image recording is applied to the first recording sheet 47 from the start of recording, the parameter C is incremented up (step S2). Thereafter, the first recording sheet 47 is fed (step S3). The feeding of the recording sheet 47 may be performed by the sheet feeding roller 25 (see FIG. 2). The recording sheet 47 may be conveyed on the conveying path 22 by the driving roller 60 and the sheet discharge roller 62. The recording sheet 47 may be conveyed up to a predetermined position and set in preparation for image recording. The predetermined position may be, for example, a position immediately before the head unit 28 and may be a position where the media sensor 115 may detect edges in the side direction at the front of the recording sheet 47.

Subsequently, it is judged whether a sheet size and a sheet type of the recording sheet 47 are the same as a sheet size and a sheet type of n previous recording sheets. The numerical value may be set according to circumstances. In this embodiment, n is set to 10. Because the recording sheet 47 is the first sheet, image recording on the recording sheet 47 is performed on the basis of the detailed control (steps S5 to S10) described below. First, a position of one edge in the main scanning direction and a position of the other edge in the main scanning direction at the front detection point of the recording sheet 47 may be detected. For example, the scanning carriage 42 may be slid (see FIG. 3), and the media sensor 115 detects the presence of the recording sheet 47, a position of one edge in the main scanning direction, and a position of the other edge in the main scanning direction of the recording sheet 47 (step S5). The "front detection point" is a detection point for quantitatively detecting positions of one edge in the side direction and the other edge in the side direction of the recording sheet 47 conveyed, and is a front position in the conveying direction of the recording sheet. The position of one edge in the main scanning direction and the position of the other edge in the main scanning direction at the front detection point are stored in the RAM of the control device 69 as edge position information of the recording sheet 47 (step S6). As described above, the control device 69 judges a sheet type of the recording sheet 47 according to a light-receiving amount of reflected light from the recording sheet 47 received by the media sensor 115 and causes the RAM to store the sheet type as sheet type information (step S7). A sheet size of the recording sheet 47 may be inputted from, for example, the operation panel 18 (see FIG. 1), and may be stored in the RAM as sheet size information (step S8). As described above, the RAM stores the edge position information, the sheet type information, and the sheet size information in association with one another as the information associated with the recording sheet 47.

Ink droplets are ejected from the recording head 43 while the scanning carriage 42 is slid, whereby an image is recorded on the recording sheet 47. At this point, image recording is performed by a conveyance distance, e.g., about ¼ inch (step S9). The recording for ¼ inch does not have to coincide with a print line feed width. Therefore, the line feed operations may be included a plurality of times in the feed amount of ¼inch. Thereafter, it is judged whether the image recording is completed for the recording sheet 47 (step S10). When images are further recorded on the recording sheet 47, steps S5 to S9 are repeated. Specifically, the edge position information and the like at the intermediate detection points of the recording sheet 47 are detected for each feed amount of ¼ inch and are stored in the RAM. Ink droplets are ejected from the recording head 43 while the scanning carriage 42 is slid again based on the edge position information and the like at the intermediate detection points stored in the RAM. In this way, the image recording is continued. The "intermediate detection point" is a detection point set at each predetermined distance (in this embodiment, ¼ inch) backward in the conveying direction with the front detection point as a reference. In this embodiment, a plurality of intermediate detection points are provided. Steps S5 to S9 are repeated until the image recording on the recording sheet 47 is completed. When the image recording on the recording sheet 47 is completed, it is judged whether the next page is present (step S11).

When image recording is not applied to the next page (the second recording sheet 47), the image recording by the complex machine 10 is finished. When image recording is applied to the second and subsequent recording sheets 47, the sheet counter C is incremented up in step S2. Because the numerical value n is set to 10, when image recording is not continuously applied to eleven or more recording sheets 47, steps S2 to S11 are repeated. In other words, when an, image is continuously recorded on a plurality of recording sheets, for the first to the (n)th (tenth) recording sheets 47, positions of one edge in the main scanning direction and positions of the other edge in the main scanning direction at the front detection point, the respective intermediate detection points, a sheet size, and a sheet type are detected in detail. The recording head 43 ejects ink droplets based on this information. This allows for satisfactory marginless recording.

When an image is recorded on the (n+1)th sheet, that is, the eleventh sheet, the sheet counter C is incremented up (step S2), and the recording sheet 47 is fed (step S3). At this point, it is judged whether sheet sizes of the first to the tenth recording sheets 47 are continuously the same (step S4). If the sheet sizes are the same, it is judged whether sheet types are the same (step S12). If the sheet sizes of the first to the tenth recording sheets 47 change, image recording is performed in accordance with steps S5 to S11 (the detailed control).

When sheet types of the first to the tenth recording sheets 47 are the same in step S12, subsequently, it is judged whether a positional deviation is within a fixed range (step S13). If the sheet types of the first to the tenth recording sheets 47 change, image recording is performed in accordance with steps S5 to S10 (the detailed control).

The positional deviation is a deviation of a position in the main scanning direction, i.e., a direction orthogonal to the conveying direction of the recording sheet 47 and a width direction of the recording sheet 47. In this embodiments the positional deviation is defined by a shift width (a deviation) of positions of one edges in the side direction of the first to the tenth recording sheets 47. In this example, when the positional deviation of the first to the tenth recording sheets 47 exceeds 0.2 mm in step S13, image recording is performed in accordance with steps S5 to S10 (the detailed control). When the positional deviation is equal to or smaller than 0.2 mm, positions of the eleventh recording sheet 47 are estimated as described below (step S14).

For the eleventh recording sheet 47, if the sheet sizes and the sheet types of the first to the tenth recording sheets 47 are the same and the positional deviation of the first to the tenth recording sheets 47 is equal to or smaller than 0.2 mm, detection of positions and the like of the eleventh recording sheet 47 is not performed, and image recording is performed based on the simplified control described later (steps S14 to S17). In other words, if the sheet sizes and the sheet types of the first to the tenth recording sheets 47 are the same and the positional deviation of the first to the tenth recording sheets is within the fixed range, in the complex machine 10, the plural recording sheets 47 continuously supplied are regarded as being accurately conveyed continuously without causing misregistration. If the recording sheets 47 are accurately conveyed continuously, the detailed control requiring a long time for image recording is suspended and the simplified control is performed instead.

When the simplified control is performed, positions of the eleventh recording sheet 47 at the time when the recording sheet 47 is conveyed are estimated (step S14). Specifically, in this embodiment, a position of one edge in the main scanning direction of the eleventh recording sheet 47 may be considered an average value of positions of one edges in the main scanning direction of the first to the tenth recording sheets 47. A position of the other edge in the main scanning direction of the eleventh recording sheet 47 may be considered as an average value of positions of the other edges in the main scanning direction of the first to the tenth recording sheets 47. For the eleventh recording sheet 47, the sliding of the scanning carriage 42 and the ejection of ink droplets from the recording head 43 are subjected to the simplified control based on the position estimated as described above.

When the average value of positions of one edges in the main scanning direction or the average value of positions of the other edges in the main scanning direction of the first to the tenth recording sheets 47 is calculated, a maximum value and a minimum value of the positions may be excluded. In other words, the maximum value and the minimum value of the positions of one edges in the main scanning direction and the maximum value and the minimum value of the positions of the other edges in the main scanning direction of the first to the tenth recording sheets 47 may be excluded, and an average value of positions of one edges in the main scanning direction or an average value of positions of the other edges in the main scanning direction may be calculated for the remaining eight recording sheets 47.

When the image is recorded according to the simplified control in this way, the simplified control counter D is incremented up (step S15). It is judged whether the counter D exceeds a predetermined value m (step S16). If the counter D is less than or equal to the predetermined value m, the image recording continues for the eleventh recording sheet 47 (step S17). Consequently, the image recording on the eleventh recording sheet is quickly performed.

If the counter D is greater than the predetermined value m, the simplified control is not performed, and the detailed control is performed. In other words, the image is recorded in accordance with steps S5 to S10. In this embodiment, the predetermined value m is set to 10. Because the initial value of the counter D is 0, recording by the simplified control is applied to the recording sheets 47 until the number of recording sheets on which the image is recorded according to the simplified control is greater than ten. Because step S16 is provided, even when the simplified control is performed, the simplified control is forcibly switched to the detailed control periodically. Therefore, even when a misregistration occurs suddenly in the recording sheets 47 continuously supplied, miss-recording does not occur for a large quantity of recording sheets 47. However, in one embodiment step S16 is omitted. When the simplified control is forcibly switched to the detailed control in step S16, the counter D is reset to the initial value 0 (step S18). Consequently, even when image recording is performed according to the simplified control, image recording according to the detailed control is performed in the ratio of one out of ten sheets. Thereafter, image recording according to the simplified control is applied to ten recording sheets again.

(n+2)th (twelfth) and subsequent recording sheets 47 are treated in the same manner as the eleventh recording sheet 47. In other words, if the sheet sizes and the sheet types of the first to the tenth recording sheets 47 are the same, and the positional deviation of the first to the tenth recording sheets 47 is within the fixed range, for twelfth and subsequent recording sheets 47 the detection of positions thereof is not performed, and the sliding of the scanning carriage 42 and the ejection of ink droplets from the recording head 43 are subjected to the simplified control based on the estimated position. Therefore, image recording on the twelfth and subsequent recording sheets 47 also is quickly performed. When there is no recording sheet 47 to be continuously supplied in step S11, the image recording work by the complex machine 10 is complete.

In this way, in the complex machine 10 according to this embodiment, when an image is continuously recorded on the plural recording sheets 47, for the first predetermined number of recording sheets 47, edge positions thereof are detected in detail. On the condition that the edge positions are within the predetermined range (on the condition that the positional deviation is within the predetermined range), for the subsequent recording sheets 47 (the respective recording sheets 47 following the predetermined number of recording sheets 47), edge positions of the subsequent recording sheets 47 are estimated based on the edge position information, sheet type information, and sheet size information of the predetermined number of recording sheets 47. The ejection of the ink droplets from the recording head 43 is controlled based on the edge positions estimated. In other words, if misregistration of the first fixed number of recording sheets 47 is small and sheet types and sheet sizes thereof are the same, for the subsequent recording sheets 47, the control device 69 of the complex machine 10 controls the ejection of ink droplets of the recording head 43 based on the already-recorded data associated with the recording sheets 47 without detecting sheet types and sheet sizes of the subsequent recording sheets 47, and without determining misregistration thereof. Therefore, image recording on the large number of recording sheets 47 is quickly performed.

Figure 10A:
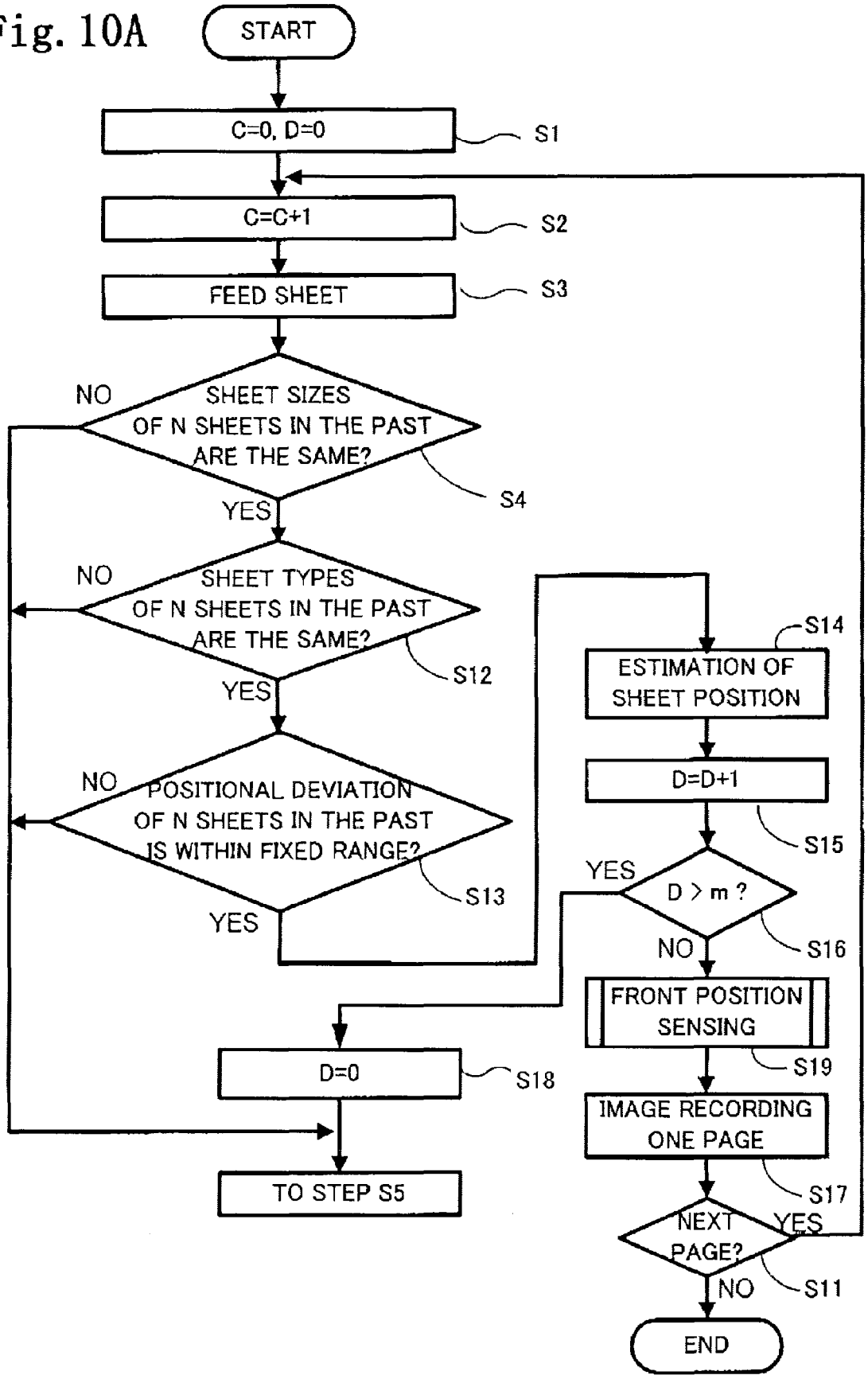
FIGS. 10A and 10B are flowcharts showing a recording procedure by a complex machine according to a second embodiment of the present invention.
Figure 10B:
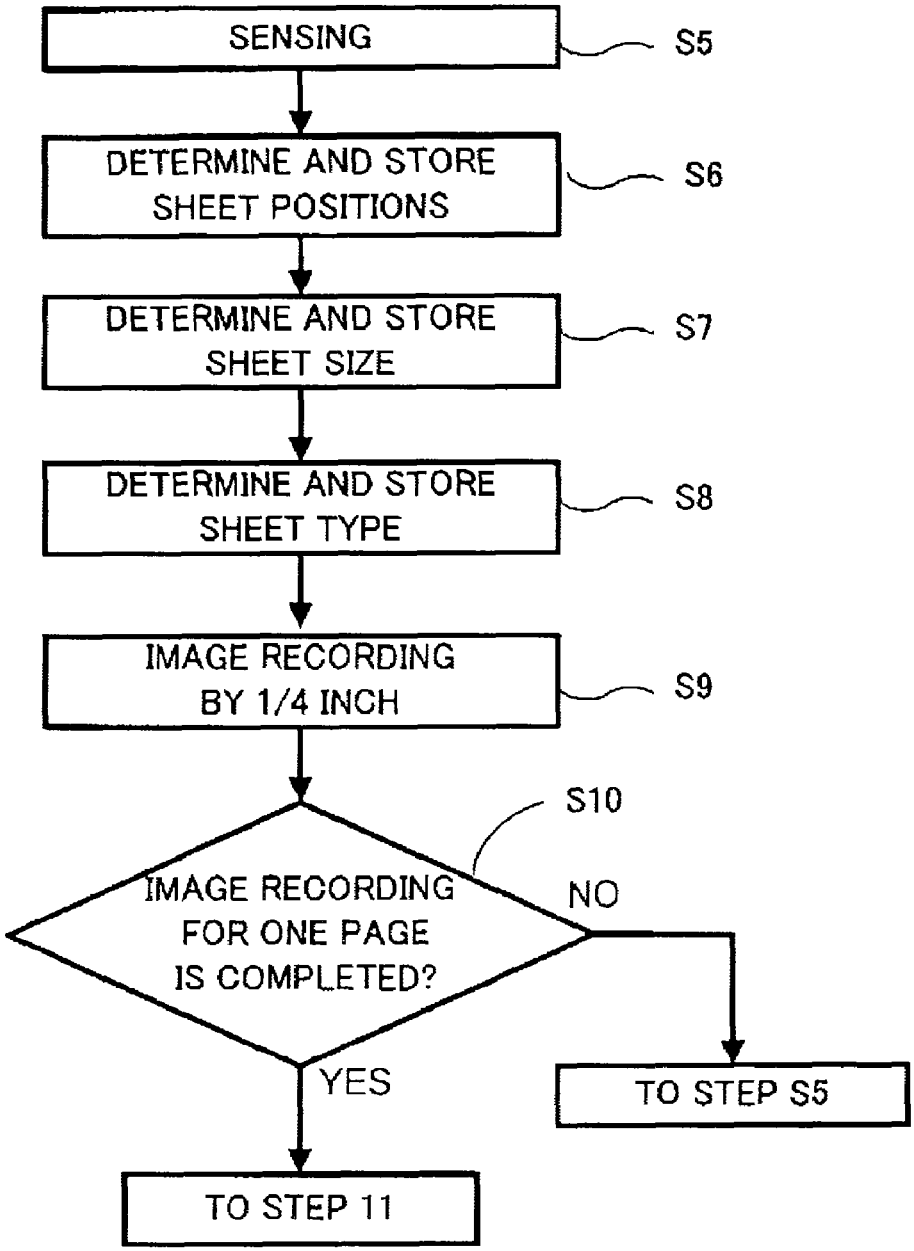

FIGS. 10A and 10B are flowcharts showing a recording procedure by the complex machine 10 according to a second embodiment of the invention. The procedure of image recording on the recording sheet 47 according to the second embodiment is substantially similar to the procedure of image recording according to the first embodiment, except that when the recording sheet 47 is subjected to image recording according to the simplified control, an edge position at the front detection point of the recording sheet 47 is sensed (step S19). Therefore, only the differences between the second embodiment and the first embodiment are discussed with respect to the second embodiment.

Figure 11:
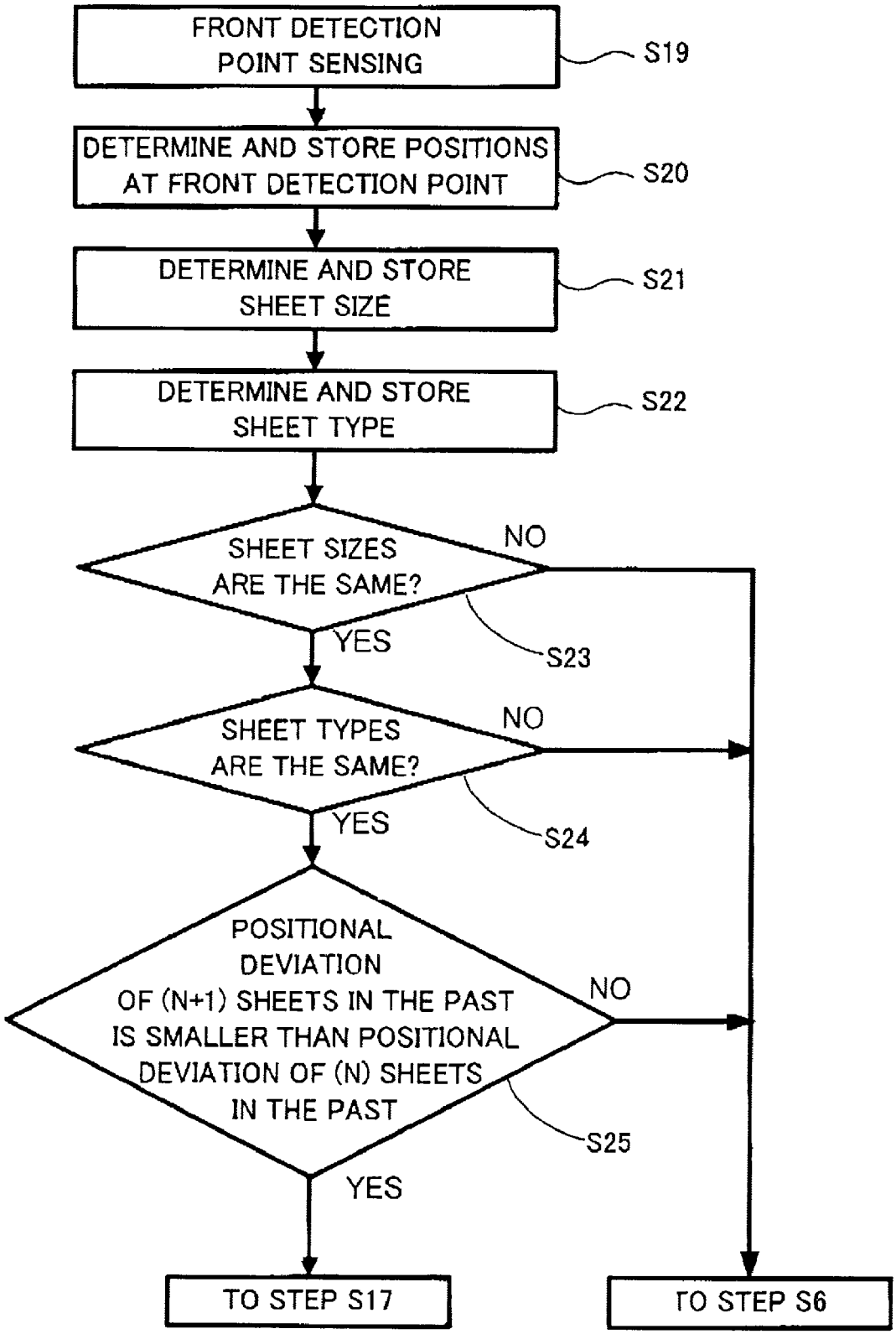
FIG. 11 is a flowchart showing the recording procedure by the complex machine according to the second embodiment of the present invention, including a flowchart showing a procedure of sensing at a front detection point.

FIG. 11 is a flowchart showing a procedure of the sensing at the front detection point.

As shown in FIG. 11, a position of one edge in the main scanning direction and a position of the other edge in the main scanning direction at the front detection point of the recording sheet 47 are detected. Specifically, the scanning carriage 42 is slid (see FIG. 3) and the media sensor 115 detects the presence of the recording sheet 47 and a position of one edge in the main scanning direction and a position of the other edge in the main scanning direction of the recording sheet 47. The position of one edge in the main scanning direction and the position of the other edge in the main scanning direction at the front detection point are stored in the RAM of the control device 69 as edge position information of the recording sheet 47 (step S20). As described above, a sheet size of the recording sheet 47 is inputted from, for example, the operation panel 18 (see FIG. 1), and is stored in the RAM as sheet size information (step S21). Moreover, the control device 69 judges a sheet type of the recording sheet 47 according to a light-receiving amount of reflected light from the recording sheet 47 received by the media sensor 115 and causes the RAM to store the sheet type as sheet type information (step S22). The RAM stores the edge position information, the sheet type information, as information associated with the recording sheet 47.

Subsequently, it is judged whether the sheet size of the recording sheet 47 and a sheet size of n (ten) recording sheets in the past are the same (step S23). If the sheet sizes are the same, subsequently, it is judged whether sheet types are the same (step S24). If the sheet sizes of the first to the tenth recording sheets 47 are not the same, image recording is performed in accordance with steps S6 to S10 (the detailed control) (see FIG. 10B). In this embodiment, data of the first to the tenth recording sheets 47 is adopted as comparative data for judging whether sheet sizes are the same. However, those of ordinary skill in the art readily will understand that the immediately preceding n (ten) recording sheets 74 in the past may be set as a reference for the comparative data.

If the sheet types of the first to the tenth recording sheets 47 are the same in step S24, subsequently, it is judged whether a positional deviation is within a predetermined range (step S25). If the sheet types of the first to the tenth recording sheets 47 are not the same, image recording is performed in accordance with steps S6 to S10 (the detailed control) (see FIG. 10B). Those of ordinary skill in the art readily will understand that data of the immediately preceding n (ten) recording sheets 47 in the past may be adopted instead of the data of the first to the tenth recording sheets 47 as the comparative data for judging whether sheet types are the same.

In this embodiment, it is judged whether a positional deviation of a first recording sheet to the recording sheet 47 is less than a positional deviation of the first to the tenth recording sheets 47 (step S25). If the positional deviation of the first recording sheet to the recording sheet 47 is less than the positional deviation of the first to the tenth recording sheets 47, the image recording according to the simplified control is continued (step S17). If the positional deviation of the first recording sheet to the recording sheet 47 is greater than the positional deviation of the first to the tenth recording sheets 47, image recording is performed according to the detailed control (steps S6 to S10) instead of the simplified control. Those of ordinary skill in the art readily will understand that the data of the immediately preceding n (ten) recording sheets 47 in the past may be adopted instead of the data of the first to the tenth recording sheets 47 as the comparative data for judging a level of a positional deviation.

As described above, in this embodiment, in image recording on the (n+1)th (eleventh) and subsequent recording sheets 47, positions of one edges in the main scanning direction and positions of the other edges in the main scanning direction at the front detection point of the recording sheets 47 and sheet sizes and sheet types of the recording sheets 47 are detected. For example, when a shift width of positions of one edges or the other edges in the side direction of the eleventh and subsequent recording sheets 47 is large, image recording is performed according to the detailed control without being subjected to the simplified control (see FIGS. 10A and 10B). Therefore, even when large misregistration suddenly occurs in the eleventh and subsequent recording sheets 47, satisfactory marginless recording is realized.

Figure 12A:
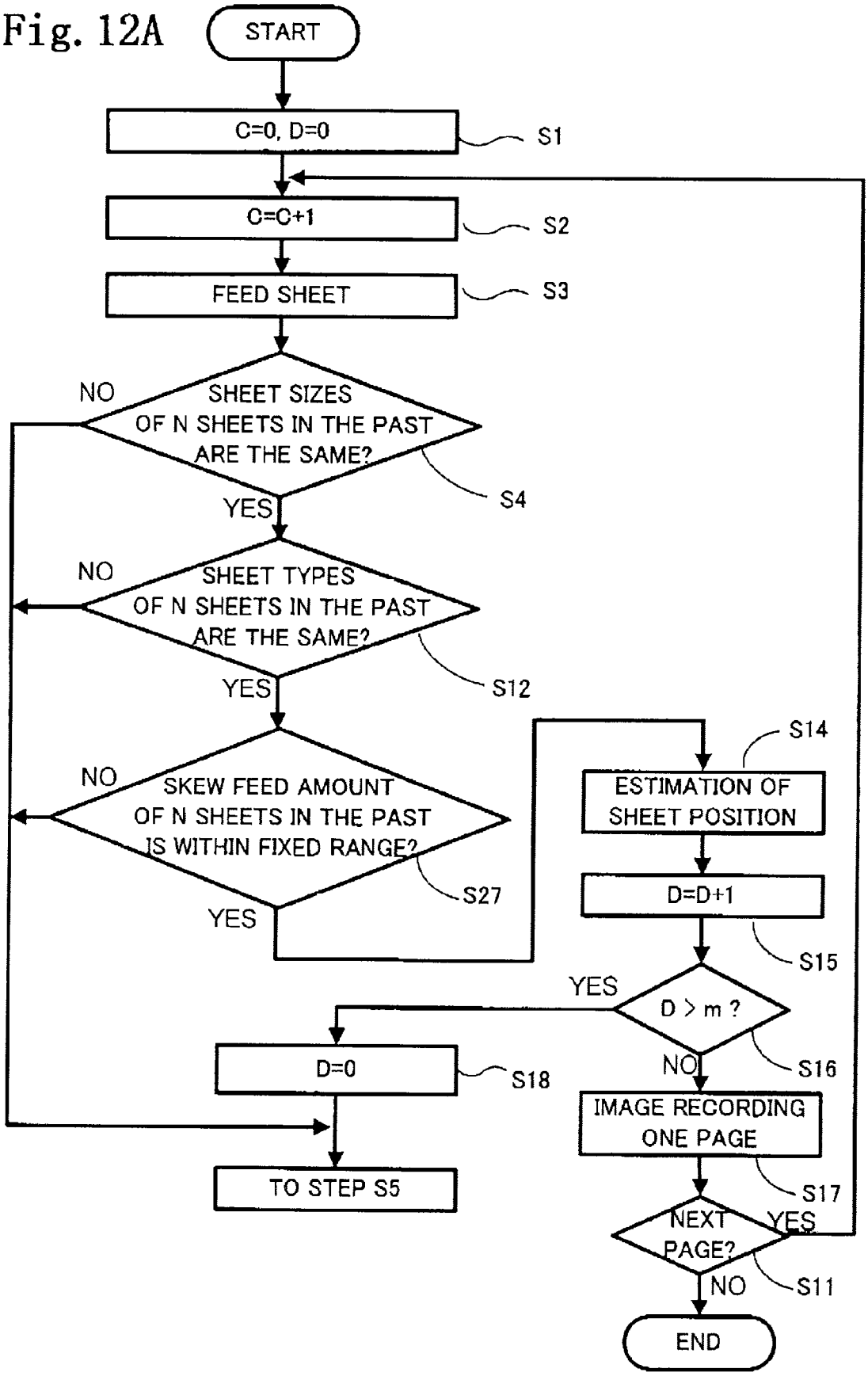
FIGS. 12A and 12B are flowcharts showing a recording procedure by a complex machine according to a third embodiment of the present invention.
Figure 12B:
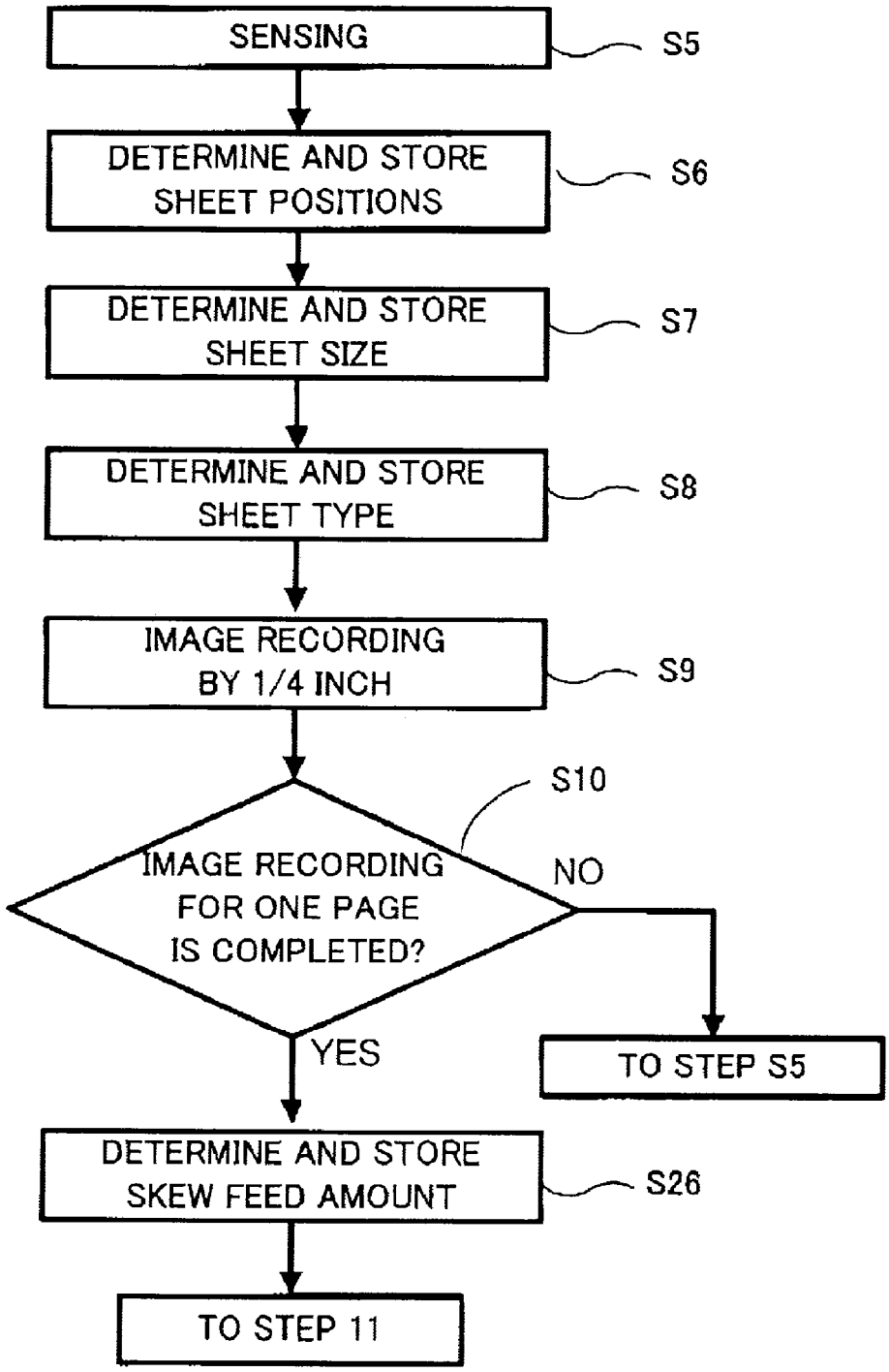

FIGS. 12A and 12B are flowcharts showing a recording procedure by the complex machine 10 according to a third embodiment of the invention. The procedure of image recording on the recording sheet 47 according to this embodiment is substantially similar to the procedure of image recording according to the first embodiment except that whereas the positional deviation is adopted as a reference of judgment for performing image recording by the simplified control in the first embodiment, a skew feed amount of a recording sheet is adopted as a reference of judgment in the third embodiment.

As shown in FIG. 12A, when recording is started based on predetermined image data (step S1), a parameter C and a parameter D are set to initial values (C=D=O). As in the first embodiment, the parameters C and D are counters associated with the recording sheet 47 that is conveyed and to which image recording is applied. The parameter C is a counter of the number of times of recording, and the parameter D is a counter of the number of times of the simplified control. When image recording is applied to the first recording sheet 47 from the start of recording, the parameter C is incremented up (step S2). Thereafter, the first recording sheet 47 is fed (step S3). The feeding of the recording sheet 47 is performed by the sheet feeding roller 25 (see FIG. 2). The recording sheet 47 is conveyed on the conveying path 22 by the driving roller 60 and the sheet discharge roller 62, and is conveyed up to a predetermined position. The predetermined position may be, for example, a position immediately before the head unit 28, and also may be a position where the media sensor 115 may detect edges in the side direction at the front of the recording sheet 47.

Subsequently, it is judged whether a size and a type of the recording sheet 47 are the same as a size and a type of n recording sheets in the past (step S4). The numerical value n may be set according to circumstances. In this embodiment, n is set to 10 as in the first embodiment. Because the recording sheet 47 is the first sheet, image recording on the recording sheet 47 is performed based on the following detailed control (steps S5 to S10). First, a position of one edge in the main scanning direction and a position of the other edge in the main scanning direction at the front detection point of the recording sheet 47 are detected. Specifically, the scanning carriage 42 is slid (see FIG. 3), and the media sensor 115 detects the presence of the recording sheet 47 and a position of one edge in the main scanning direction and a position of the other edge in the main scanning direction of the recording sheet 47 (step S5). The position of one edge in the main scanning direction and the position of the other edge in the main scanning direction at this front detection point are stored in the RAM of the control device 69 as edge position information of the recording sheet 47 (step S6). As described above, the control device 69 judges a sheet type of the recording sheet 47 according to a light-receiving amount of reflected light from the recording sheet 47 received by the media sensor 115, and causes the RAM to store the sheet type as sheet type information (step S7). A sheet size of the recording sheet 47 is inputted from, for example, the operation panel 18 (see FIG. 1), and is stored in the RAM as sheet size information (step S8). As described above, the RAM stores the edge position information, the sheet type information, and the sheet size information as information associated with the recording sheet 47.

Ink droplets are ejected from the recording head 43 while the scanning carriage 42 is slid, and an image is recorded on the recording sheet 47. At this point, image recording is performed by a predetermined conveyance distance (a feed amount) (step S9). In this embodiment, the predetermined conveyance distance is set to ¼ inch. The recording for ¼ inch does not have to coincide with a print line feed width. Therefore, a plurality of line feed operations may be included in the feed amount of ¼ inch. Thereafter, it is judged whether the image recording is completed for the recording sheet 47 (step S10). When images are further recorded on the recording sheet 47, steps S5 to S9 are repeated. Specifically, the edge position information and the like at the intermediate detection points of the recording sheet 47 are detected for each feed amount of ¼ inch, and are stored in the RAM. Ink droplets are ejected from the recording head 43 while the scanning carriage 42 is slid again based on the edge position information and the like at the intermediate detection points stored in the RAM. In this way, the image recording is continued. Steps S5 to S9 are repeated until the image recording is completed for the recording sheet 47.

When the image recording on the recording sheet 47 is completed in step S10, it is judged whether the next page is present (step S11). A skew feed amount of the recording sheet 47 is detected from a position of one edge in the main scanning direction and a position of the other edge in the main scanning direction at a last intermediate detection point (an intermediate detection point on a rearmost edge side of the recording sheet). Specifically, the CPU of the control device 69 calculates a skew, feed amount of the recording sheet 47 from the position of one edge in the main scanning direction at the front detection point and the position of one edge in the main scanning direction at the last intermediate detection point. The skew feed amount represents a degree of the recording sheet 47 conveyed being skew-fed with respect to the conveying direction. For example, the skew feed amount is determined by a deviation between the position of one edge in the main scanning direction at the front detection point and the position of one edge in the main scanning direction at the last intermediate detection point. The skew feed amount is stored in the RAM as edge position information (step S26).

Thereafter, it is judged whether the next page is present (step S11). When image recording is not applied to the next page (the second recording sheet 47), the image recording by the complex machine 10 is complete. When image recording is applied to the second and subsequent recording sheets 47, the sheet counter C is incremented up in step S2. Because the numerical value n is set to 10, when image recording is not continuously applied to eleven or more recording sheets 47, steps S2 to S10, step S26, and step S11 are repeated. In other words, when an image is continuously recorded on the plural recording sheets 47, for the first to the (n)th (tenth) recording sheets 47, positions of one edge in the main scanning direction, positions of the other edge in the main scanning direction at the front detection point, the respective intermediate detection points, a sheet size, a sheet type, and a skew feed amount are detected in detail. The recording head 43 ejects ink droplets based on information. This makes it possible to perform satisfactory marginless recording.

When an image is recorded on the (n+1)th sheet, that is, the eleventh sheet 47, the sheet counter C is incremented up (step S2) and the recording sheet 47 is fed (step S3). At this point, it is judged whether sheet sizes of the first to the tenth recording sheets 47 are the same (step S4). If the sheet sizes are the same, it is judged whether sheet types are the same (step S12). If the sheet sizes of the first to the tenth recording sheets 47 are not the same, image recording is performed in accordance with steps S5 to S10 and step S26 (the detailed control).

When sheet types of the first to the tenth recording sheets 47 are the same in step S12, subsequently, it is judged whether the skew feed amount is within a fixed skew feed range (step S27). If the sheet types of the first to the tenth recording sheets 47 are not the same, recording is performed in accordance with steps S5 to S10 and step S26 (the detailed control).

When a skew feed amount of the first to the tenth recording sheets 47 is greater than a predetermined skew feed amount, e.g., about 1.0 mm, in step S27, image recording is performed in accordance with steps S5 to S10 and step S26 (the detailed control). When the skew feed amount is less than or equal to the predetermined skew feed amount, positions of the eleventh recording sheet 47 are estimated as described below (step S14).

In other words, for the eleventh recording sheet 47, if sheet sizes and sheet types of the first to the tenth recording sheets 47 are the same and the skew feed amount is less than or equal to the predetermined skew feed amount, detection of positions and the like of the eleventh recording sheet 47 is not performed, and image recording is performed based on the simplified control described later (steps S14 to S17). In other words, if the sheet sizes and the sheet types of the first to the tenth recording sheets 47 are the same and the skew feed amount of the first to the tenth recording sheets is within the fixed range, in the complex machine 10, the plurality of recording sheets 47 continuously supplied are regarded as being accurately conveyed continuously without causing misregistration. In that case, the detailed control requiring a long time for image recording is suspended and the simplified control is performed instead.

When the simplified control is performed, positions of the eleventh recording sheet 47 at the time when the recording sheet 47 is conveyed are estimated (step S14). Specifically, in this embodiment, a position of one edge in the main scanning direction of the eleventh recording sheet 47 is considered to be as an average value of positions of the one edges in the main scanning direction of the first to the tenth recording sheets 47. A position of the other edge in the main scanning direction of the eleventh recording sheet 47 may be considered to be an average value of positions of the other edges in the main scanning direction of the first to the tenth recording sheets 47. For the eleventh recording sheet 47, a position of the recording sheet 47 is estimated as described above, and the sliding of the scanning carriage 42 and the ejection of the ink droplets from the recording head 43 are subjected to the simplified control based on this position.

In this embodiment, as in the embodiments described above, when the average value of positions of the one edges in the main scanning direction or the average value of positions of the other edges in the main scanning direction of the first to the tenth recording sheets 47 is calculated, a maximum value and a minimum value of the positions may be excluded. In other words, a maximum value and a minimum value of the positions of the one edges in the main scanning direction and a maximum value and a minimum value of the positions of the other edges in the main scanning direction of the first to the tenth recording sheets 47 may be excluded, and an average value of positions of the one edges in the main scanning direction or an average value of positions of the other edges in the main scanning direction may be calculated for the remaining eight recording sheets 47.

When the image is recorded according to the simplified control in this way, the simplified control counter D is incremented up (step S15). It is judged whether the counter D exceeds a predetermined value m (step S16). If the counter D is less than or equal to the predetermined value m, the image recording is continued for the eleventh recording sheet 47 (step S17). Therefore, the image recording on the eleventh recording sheet is quickly performed.

If the counter D is greater than the predetermined value m, the simplified control is not performed, and the detailed control is performed. In other words, the image is recorded in accordance with steps S5 to S10. In this embodiment, the predetermined value m is set to 10 as in the embodiments described above. Because the initial value of the counter D is 0, recording by the simplified control is applied to the recording sheets 47 until the number of recording sheets on which the image is recorded according to the simplified control is greater than ten. Because step S16 is provided, even when the simplified control is performed, the simplified control is forcibly switched to the detailed control periodically. Therefore, even when the recording sheets 47 continuously supplied are suddenly skew-fed by a large degree, miss-recording does not occur for a large quantity of recording sheets 47. However, in a modification of this embodiment, step S16 may be omitted. When the simplified control is forcibly switched to the detailed control in step S16, the counter D is reset to the initial value 0 (step S18). Consequently, even when image recording is performed according to the simplified control, image recording according to the detailed control is performed in the ratio of one out of ten sheets. Thereafter, image recording according to the simplified control is applied to ten recording sheets again.

(n+2)th (twelfth) and subsequent recording sheets 47 are treated in the same manner as the eleventh recording sheet 47. In other words, if the sheet sizes and the sheet types of the first to the tenth recording sheets 47 are the same and the skew feed amount of the first to the tenth recording sheets 47 is within the fixed skew feed range, for twelfth and subsequent recording sheets 47, the detection of positions thereof is not performed, and the sliding of the scanning carriage 42 and the ejection of the ink droplets from the recording head 43 are subjected to the simplified control. Therefore, image recording on the twelfth and subsequent recording sheets 47 also is quickly performed. When there is no recording sheet 47 to be continuously supplied in step S11, the image recording work by the complex machine 10 is complete.

In this embodiment, data of the first to the tenth recording sheets 47 is adopted as comparative data for judging whether sheet sizes are the same and whether sheet types are the same and as data for judging the skew feed amount. However, those of ordinary skill in the art readily will understand that the immediately preceding n (ten) recording sheets 47 in the past may be set as a reference instead of the data. In other words, data concerning the second to the eleventh recording sheets 47 may be adopted for judgment on whether the simplified control is applied to the twelfth recording sheet 47 and data concerning (k−11)th to (k−1)th recording sheets 47 may be adopted for judgment on whether, in general, the simplified control is applied to a kth recording sheet 47.

In this way, in the complex machine 10 according to this embodiment, as in the first embodiment, when an image is continuously recorded on the plurality of recording sheets 47, for the first predetermined number of recording sheets 47, edge positions thereof are detected in detail. On satisfaction of the condition that the edge positions are within the predetermined range (on satisfaction of the condition that the skew feed amount is within the predetermined skew feed range), for the subsequent recording sheets 47 (the respective recording sheets 47 following the predetermined number of recording sheets 47), edge positions of the subsequent recording sheets 47 are estimated on the basis of edge position information, sheet type information, and sheet size information of the predetermined number of recording sheets 47. Ejection of ink droplets from the recording head 43 is controlled based on the edge positions estimated. In other words, if misregistration of the first fixed number of recording sheets 47 is small and the sheet types and the sheet sizes thereof are the same, for the subsequent recording sheets 47, the control device 69 of the complex machine 10 controls ejection of ink droplets of the recording head 43 based on already-recorded data concerning the recording sheets 47 without detecting the sheet types and the sheet sizes of the subsequent recording sheets 47 and misregistration thereof. Therefore, image recording on the large number of recording sheets 47 is quickly performed.

Figure 13A:
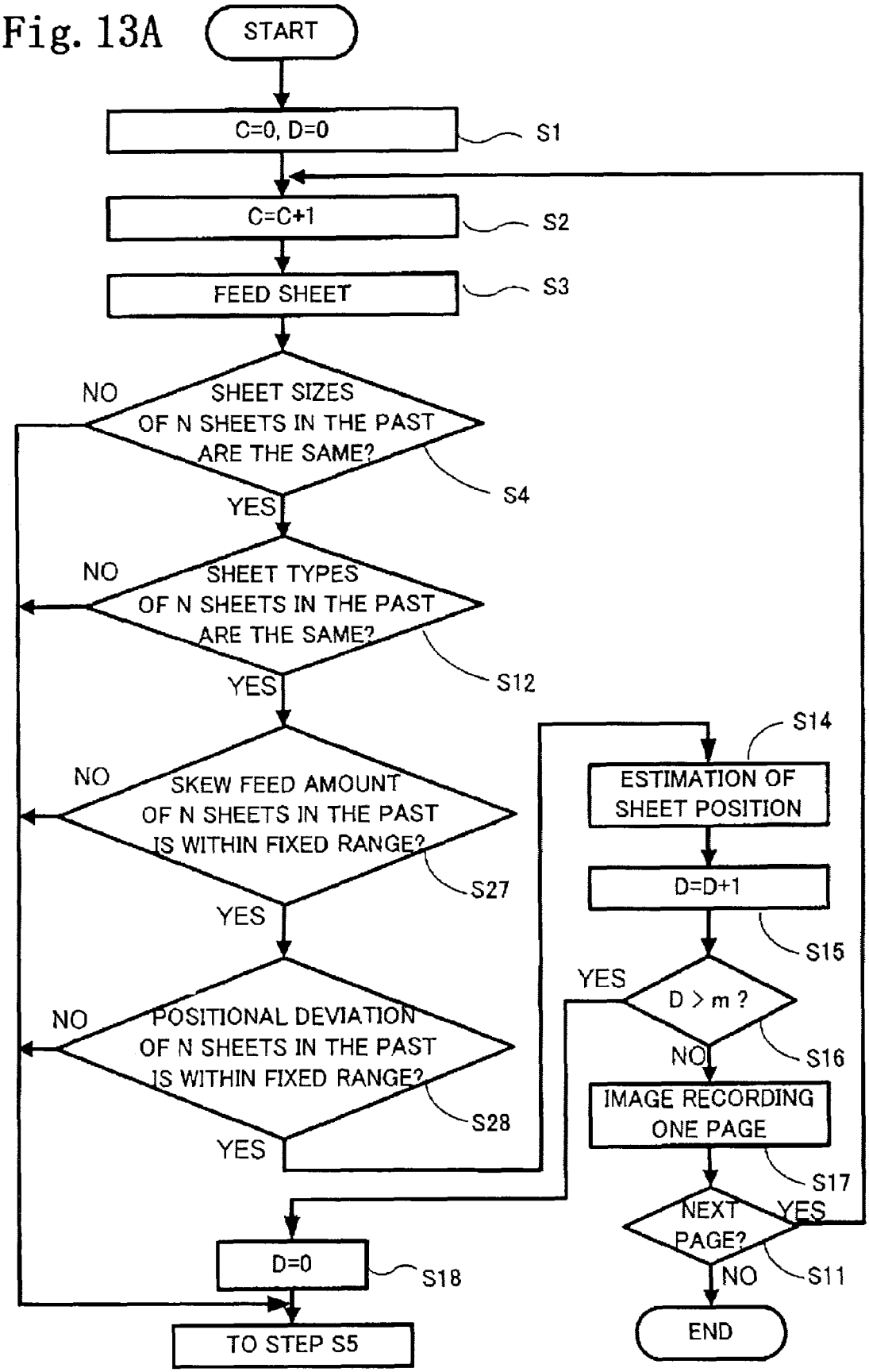
FIGS. 13A and 13B are flowcharts showing a recording procedure by a complex machine according to a fourth embodiment of the present invention.
Figure 13B:
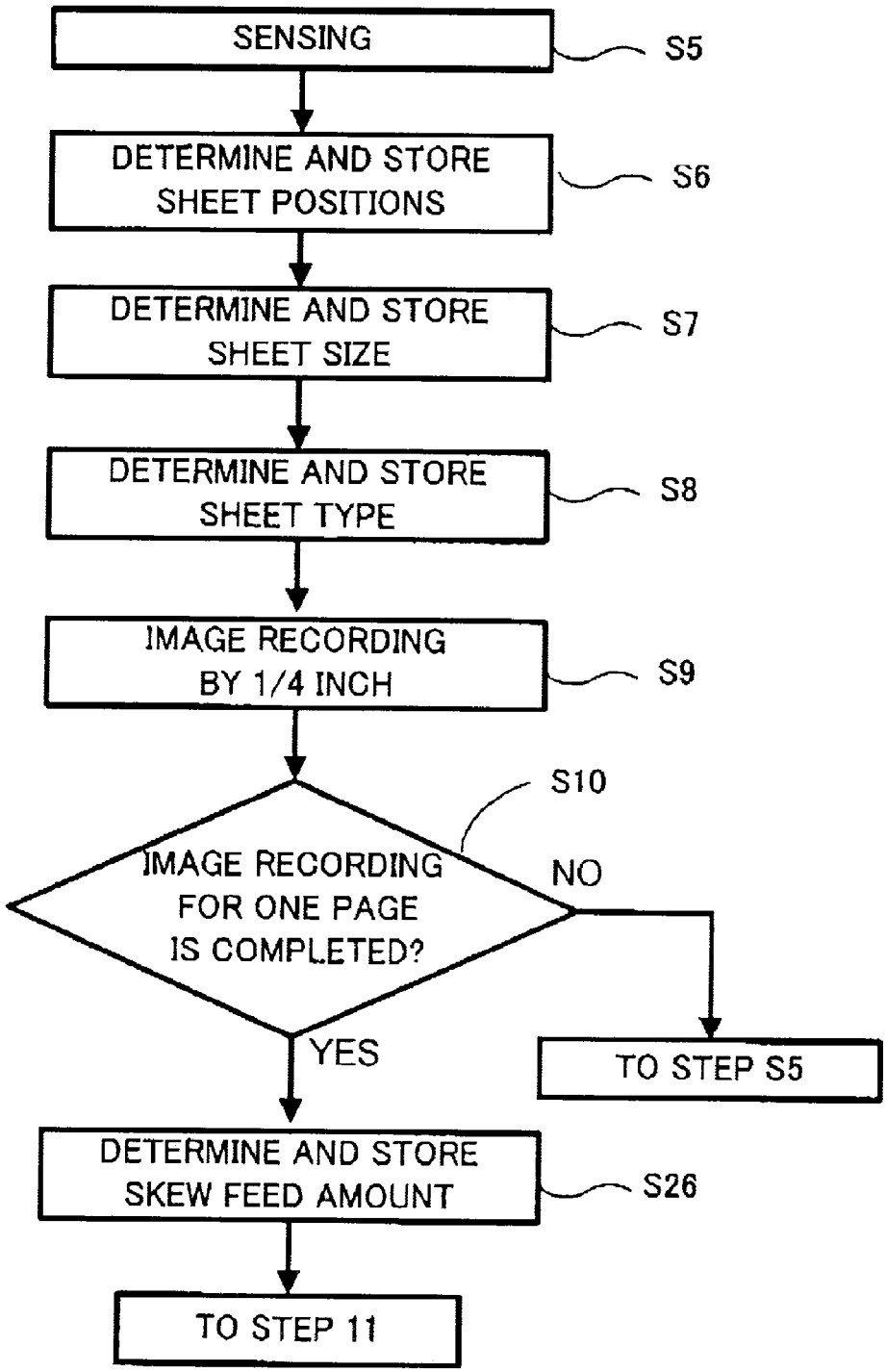

FIGS. 13A and 13B are flowcharts showing a recording procedure by the complex machine 10 according to a fourth embodiment of the invention. The procedure of image recording on the recording sheet 47 according to this embodiment is substantially similar to the procedure of image recording according to the third embodiment, except that, as requirements for applying image recording to the recording sheet 47 according to the simplified control, a requirement that a positional deviation of n recording sheets 47 in the past is within a fixed range is added (step S28). Therefore, only the differences between the fourth embodiment and the third embodiment are discussed with respect to the fourth embodiment.

In step S28, when a positional deviation of the first to the tenth recording sheets 47, that is, a shift width of positions of one edges in the side direction of the first to the tenth recording sheets 47 exceeds 0.2 mm, image recording is performed in accordance with steps S5 to S10 and step S26 (the detailed control). When the positional deviation is equal to or smaller than 0.2 mm, positions of the eleventh recording sheet 47 are estimated as described above (step S14) and image recording is performed in accordance with the simplified control. In step S28, the positional deviation of the first to the tenth recording sheets 47 is adopted as a reference of judgment on whether the simplified control is performed. However, those of ordinary skill in the art readily will understand that a positional deviation of the immediately preceding n (ten) recording sheets 47 in the past may be adopted instead of the positional deviation.

In this embodiment the simplified control is performed only when a skew feed amount of the (n+1)th (the eleventh)

and subsequent recording sheets 47 is within the fixed skew feed range and a positional deviation of the recording sheets 47 is within the fixed range. Thus, even when sudden misregistration or skew feed of the recording sheets occurs, miss-recording caused by the misregistration or the skew feed may be prevented.

Figure 14A:
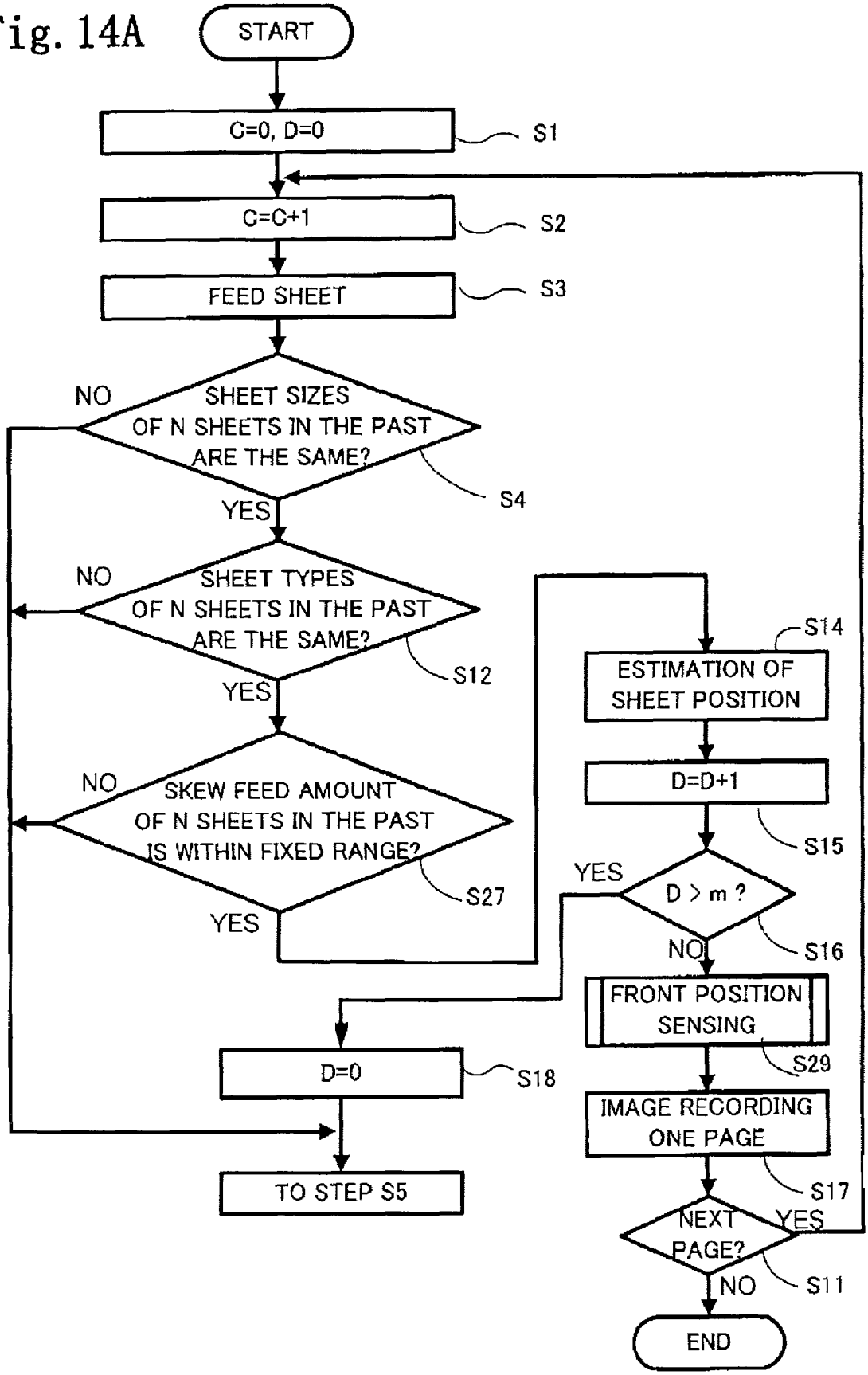
FIGS. 14A and 14B are flowcharts showing a recording procedure by a complex machine according to a fifth embodiment of the present invention.
Figure 14B:
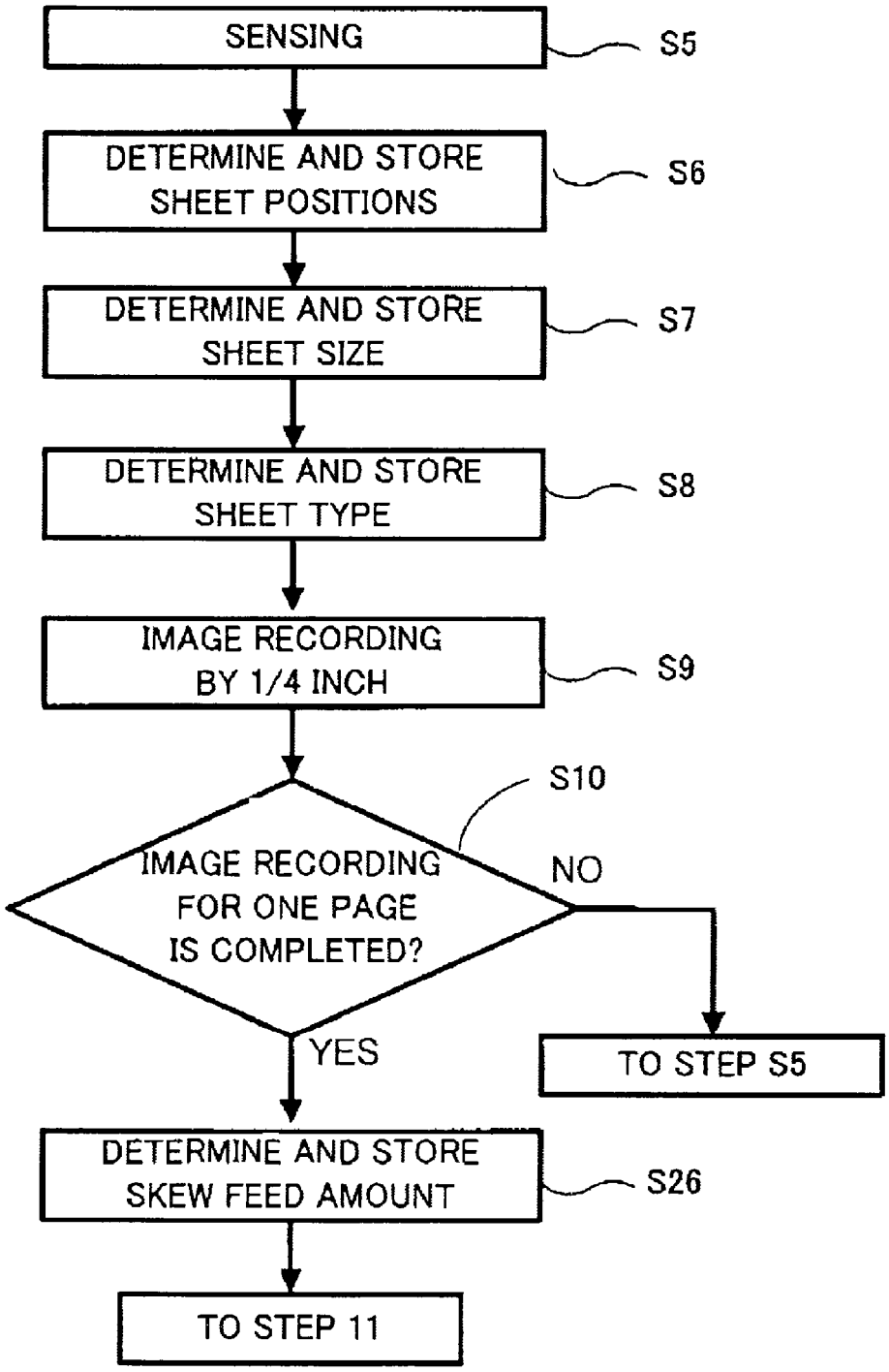

FIGS. 14A and 14B are flowcharts showing a recording procedure by the complex machine 10 according to a fifth embodiment of the invention. The procedure of image recording on the recording sheet 47 according to this embodiment is substantially similar to the procedure of image recording according to the third embodiment, except that when the recording sheet 47 is subjected to image recording according to the simplified control, edge positions at the front detection point of the recording sheet 47 are subjected to sensing (step S29).

Figure 15:
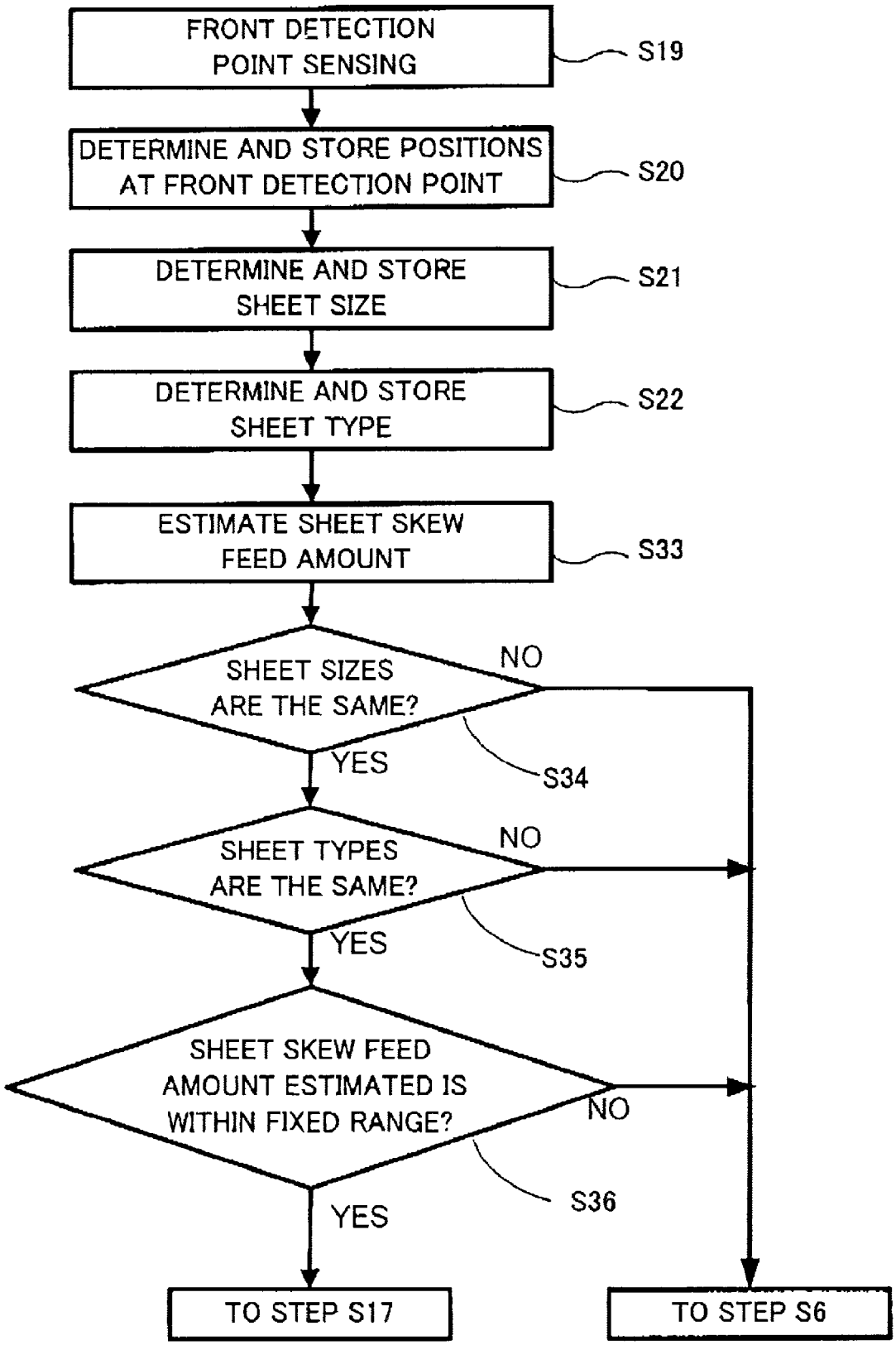
FIG. 15 is a flowchart showing the recording procedure by the complex machine according to the fifth embodiment of the present invention, including a flowchart showing a procedure of sensing at a front detection point.

FIG. 15 is a flowchart showing a procedure of sensing at the front detection point. As shown in FIG. 15, a position of one edge in the main scanning direction and a position of the other edge in the main scanning direction at the front detection point of the recording sheet 47 (the (n+1)th recording sheet) are detected. Specifically, the scanning carriage 42 is slid (see FIG. 3) and the media sensor 115 detects the presence of the recording sheet 47 and the position of one edge in the main scanning direction and the position of the other edge in the main scanning direction of the recording sheet 47. The position of one edge in the main scanning direction and the position of the other edge in the main scanning direction at the front detection point are stored in the RAM of the control device 69 as edge position information of the recording sheet 47 (step S30). As described above, a sheet size of the recording sheet 47 is inputted from, for example, the operation panel 18 (see FIG. 1), and is stored in the RAM as sheet size information (step S31). Moreover, the control device 69 judges a sheet type of the recording sheet 47 according to a light-receiving amount of reflected light from the recording sheet 47 received by the media sensor 115, and causes the RAM to store the sheet type as sheet type information (step S32).

A skew feed amount of the recording sheet 47 is estimated based on the position of one edge in the main scanning direction, the position of the other edge in the main scanning direction of the recording sheet 47, and a skew feed amount of n (ten) recording sheets 47 in the past (step S33). Specifically, the CPU of the control device 69 calculates a skew feed amount of the recording sheet 47 based on the position of one edge in the main scanning direction, the position of the other edge in the main scanning direction of the recording sheet 47, and a skew feed amount of n (ten) recording sheets 47 in the past. The skew feed amount calculated is stored in the RAM as a skew feed amount, which is edge position information of the recording sheet 47. The RAM stores the edge position information, the sheet type information, and the sheet size information as information associated with the recording sheet 47. In this case, as described above, in calculation of a skew feed amount, data of the first to the tenth recording sheets 47 may be used. However, those of ordinary skill in the art readily will understand that data of immediately preceding n (ten) recording sheets 47 in the past may be adopted instead of the data.

Subsequently, it is judged whether the sheet size of the recording sheet 47 and a sheet size of n (ten) recording sheets in the past are the same (step S34). If the sheet sizes are the same, subsequently, it is judged whether sheet types are the same (step S35). If the sizes of the first to the tenth recording sheets 47 are not the same, image recording is performed in accordance with steps S6 to S10 and step S26 (the detailed control) (see FIG. 14B). In this embodiment, data of the first to the tenth recording sheets 47 may be adopted as comparative data for judging whether sheet sizes are the same. However, those of ordinary skill in the art readily will understand that with respect to the comparison data, the immediately preceding n (ten) recording sheets 74 in the past may be set as a reference.

If the sheet types of the first to the tenth recording sheets 47 are the same in step S35, subsequently, it is judged whether the skew feed amount estimated (the skew feed amount calculated) is within a predetermined skew feed range (step S36). If the types of the first to the tenth recording sheets 47 are not the same, image recording is performed in accordance with steps S6 to S10 and step S26 (the detailed control) (see FIG. 14B). Those of ordinary skill in the art readily will understand that data of the immediately preceding n (ten) recording sheets 47 in the past may be adopted instead of the data of the first to the tenth recording sheets 47 as the comparative data for judging whether sheet types are the same.

In this embodiment, it is judged whether the estimated skew feed amount is less than or equal to a predetermined skew feed amount, e.g., 1.0 mm (step S36). If the estimated skew feed amount is less than or equal to 1.0 mm, the image recording according to the simplified control is continued (step S17). If the estimated skew feed amount is greater than 1.0 mm, image recording is performed according to the detailed control (steps S6 to S10 and step S26) instead of the simplified control.

As described above, in this embodiment, in Image recording on the (n+1)th (eleventh) and subsequent recording sheets 47, positions of one edges in the main scanning direction and positions of the other edges in the main scanning direction at the front detection point of the recording sheets 47 and sheet sizes and sheet types of the recording sheets 47 are detected, and a skew feed amount of the recording sheets 47 is estimated. In image reading on the eleventh and subsequent recording sheets 47, when the skew feed amount estimated of the recording sheets 47 exceeds the fixed skew feed range, image recording is performed according to the detailed control. Therefore, even when it is likely that the eleventh and subsequent recording sheets 47 are suddenly skew-fed by a large degree, satisfactory marginless recording is realized.

Figure 16A:
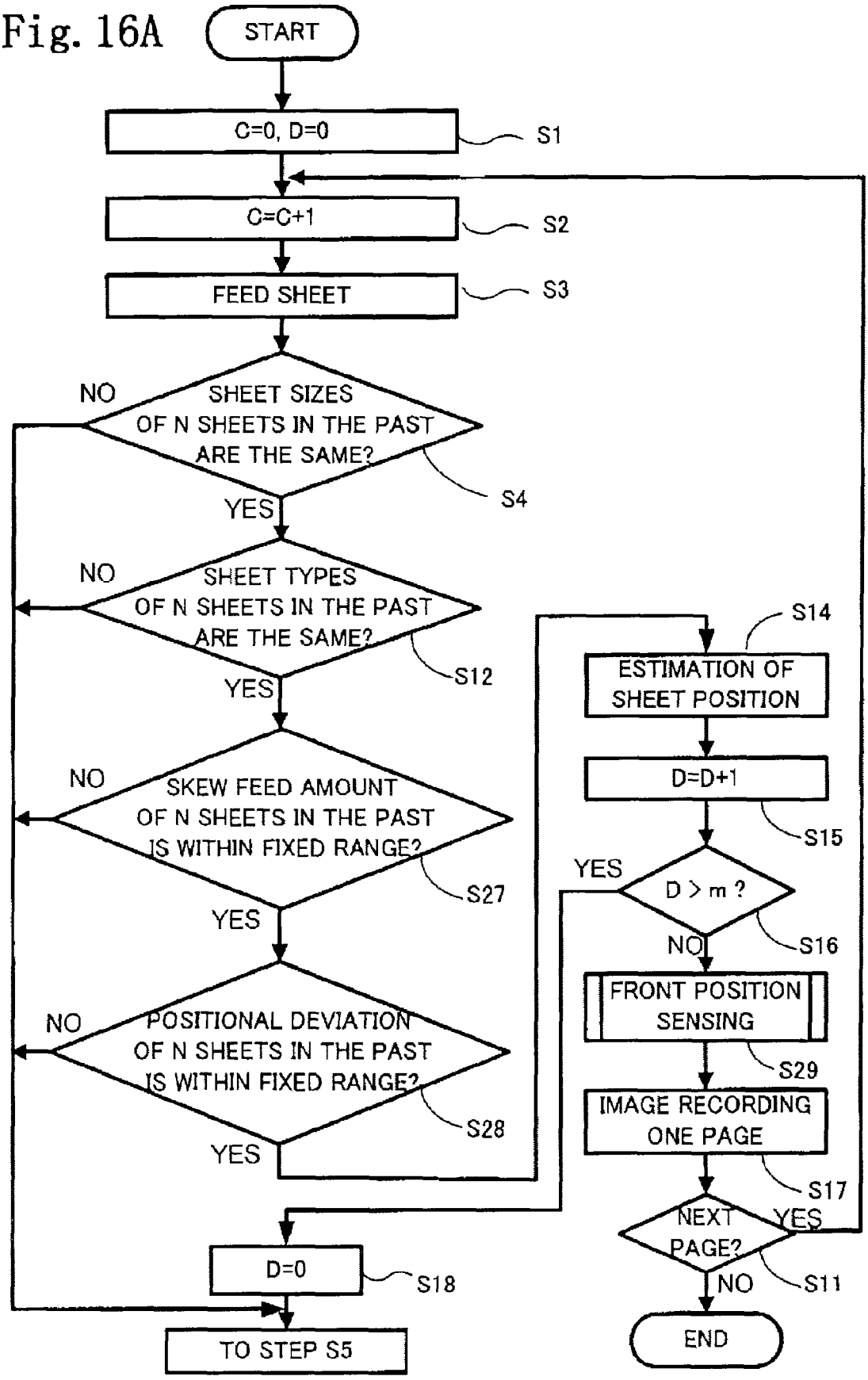
FIGS. 16A and 16B are flowcharts showing a recording procedure by a complex machine according to a sixth embodiment of the present invention.
Figure 16B:
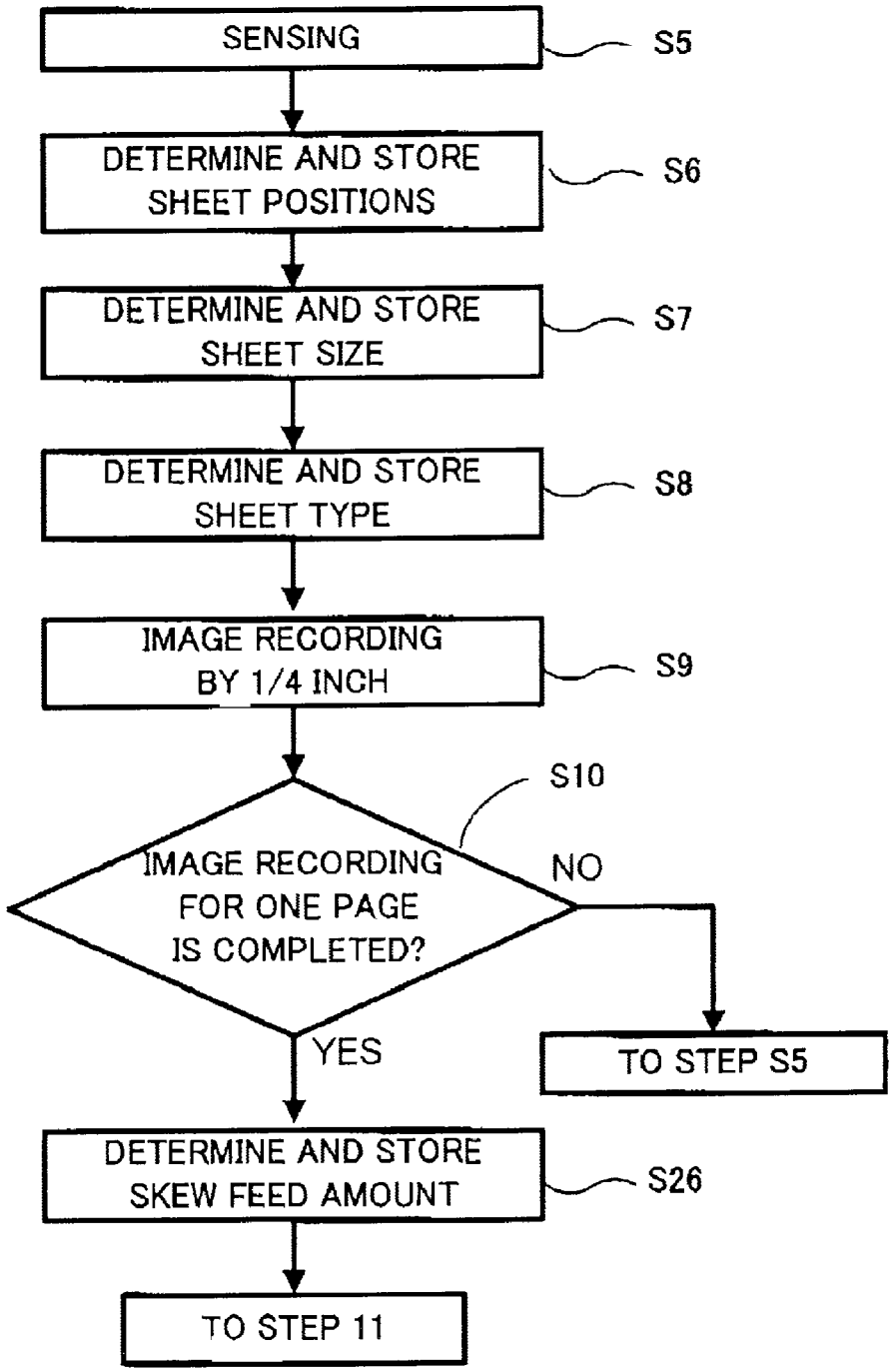

FIGS. 16A and 16B are flowcharts showing a recording procedure by the complex machine 10 according to a sixth embodiment of the invention. The procedure of image recording on the recording sheet 47 according to this embodiment is substantially similar to the procedure of image recording according to the fourth embodiment, except that, when the recording sheet 47 is subjected to image recording by the simplified control, edge positions at the front detection point of the recording sheet 47 are subjected to sensing (step S29). Therefore, only the differences between the sixth embodiment and the fourth embodiment are discussed with respect to the sixth embodiment.

Step S29 is as described above (the fifth embodiment). In this embodiment, the simplified control is performed only when a skew feed amount of the (n+1)th (the eleventh) and subsequent recording sheets 47 is within a fixed skew feed range and a positional deviation of the recording sheets 47 is within a fixed range. Thus, even when sudden misregistration or skew feed of the recording sheets 47 occurs, miss-recording caused by the misregistration or the skew feed may be prevented. In addition, in image recording on the eleventh and subsequent recording sheets 47, positions of one edges in the main scanning direction and positions of the other edges in the main scanning direction at the front detection point of the recording sheets 47 and sheet sizes and sheet types of the recording sheets 47 are detected, and a skew feed amount of the recording sheets 47 is estimated. In the image recording on the eleventh and subsequent recording sheets 47, when the skew feed amount estimated of the recording sheets 47 exceeds the fixed skew feed range, the image recording is performed according to the detailed control. Therefore, even when it is likely that the eleventh and subsequent recording sheets 47 are suddenly skew-fed by a large degree, satisfactory marginless recording is realized.

In this embodiment, in the image recording on the (n+1)th and subsequent recording sheets 47, it is judged whether the estimated skew feed amount of the recording sheets 47 is within the fixed range. However, instead of this, the image recording may be performed according to the detailed control without being subjected to the simplified control when a positional deviation of the immediately preceding n recording sheets 47 in the past is within the fixed range.

While the invention has been described in connection with preferred embodiments, it will be understood by those skilled in the art that other variations and modifications of the preferred embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the flowing claims.

What is claimed is:

1. An ink jet recording apparatus, comprising:

a conveying mechanism configured to sequentially convey a plurality of recording sheets in a predetermined conveying direction;

a detector comprising a light source for irradiating light on a surface of the recording sheet and a light-receiving element for receiving reflected light from the recording sheet, wherein the detector is configured to detect at least one edge position of each of the plurality of recording sheets when the conveying mechanism conveys each of the plurality of recording sheets to a predetermined position;

an ink jet recording head configured to eject ink droplets on each of the plurality of recording sheets;

a scanning carriage configured to move in a main scanning direction orthogonal to the conveying direction, wherein the detector and the ink jet recording head are mounted to the scanning carriage;

a determining unit configured to determine at least one characteristic of each of the plurality of recording sheets;

a storing unit configured to store the at least once edge position of each of the plurality of recording sheets and the at least one characteristic of each of the plurality of recording sheets, wherein an image is recorded on each of the plurality of recording sheets when ink droplets are ejected from the ink jet recording head while the conveying mechanism conveys the recording sheets and the scanning carriage moves in the main scanning direction; and a controller, wherein when at least one predetermined condition associated with the plurality of recording sheets is satisfied, the controller is configured to control the ejection of ink droplets on at least one subsequent recording sheet, which sequentially is conveyed after a last of the plurality of recording sheets is conveyed, based at least on the at least one edge position of each of the plurality recording sheets and the at least one characteristic of each of the plurality of the recording sheets.

2. The ink jet recording apparatus of claim 1, wherein the at least one characteristic comprises a sheet type of each of the plurality of recording sheets, and the determining unit comprises a judging unit configured to determine the sheet type of each the plurality of recording sheets based on an amount of light received by the light receiving element.

3. The ink jet recording apparatus of claim 1, wherein the at least one characteristic comprises a size of each of the plurality of recording sheets, and the determining unit comprises an input reception unit configured to receive an input associated with the size of each of the plurality of recording sheets.

4. The ink jet recording apparatus of claim 2, wherein the at least one characteristic further comprises a size of each of the plurality of recording sheets, and the determining unit further comprises an input reception unit configured to receive an input associated with the size of each of the plurality of recording sheets.

5. The ink jet recording apparatus of claim 1, wherein the at least one predetermined condition comprises the at least one edge position of each of the plurality of recording sheets being within a predetermined edge position range.

6. The ink jet apparatus of claim 5, wherein the at least one predetermined condition further comprises a size of each of the plurality of recording sheets being the same.

7. The ink jet apparatus of claim 6, wherein the at least one predetermined condition further comprises a type of each of the plurality of recording sheets being the same.

8. The ink jet apparatus of claim 1, wherein the at least one predetermined condition comprises a size of each of the plurality of recording sheets being the same.

9. The ink jet apparatus of claim 8, wherein the at least one predetermined condition further comprises a type of each of the plurality of recording sheets being the same.

10. The ink jet apparatus of claim 1, wherein the at least one predetermined condition comprises a type of each of the plurality of recording sheets being the same.

11. The ink jet apparatus of claim 1, wherein when the at least one predetermined condition is satisfied, the detector does not detect the at least one edge position of the at least one subsequent recording sheet.

12. The ink jet apparatus of claim 1, wherein when the at least one predetermined condition is satisfied, the determining unit does not determine the at least one characteristic of the at least one subsequent recording sheet.

13. The ink jet apparatus of claim 1, wherein when the at least one predetermined condition is not satisfied, the detector detects the at least one edge position of the at least one subsequent recording sheet, and the determining unit determines the at least one characteristic of the at least one subsequent recording sheet, and the controller controls the ejection of ink droplets on the at least one subsequent recording sheet based on the at least one characteristic of the at least one subsequent recording sheet and the at least one edge position of the at least one subsequent recording sheet.

14. The ink jet recording apparatus according to claim 6, wherein the detector detects the position of one edge of each of the plurality of recording sheets in the main scanning direction and the position of the other edge of each of the plurality of recording sheets in the main scanning direction at a front detection point of each of the plurality of recording sheets and at an intermediate detection point of each of the plurality of recording sheets provided backward in the conveying direction at a predetermined interval from the front detection point, the storing unit stores the position of the one edge of each of the plurality of recording sheets in the main scanning direction and the position of the other edge of each of the plurality of recording sheets in the main scanning direction as the at least one edge position, and the at least one predetermined condition further comprises a positional deviation of the plurality of recording sheets being with a predetermined positional deviation range.

15. The ink jet recording apparatus according to claim 7, wherein the detector detects the position of one edge of each of the plurality of recording sheets in the main scanning direction and the position of the other edge of each of the plurality of recording sheets in the main scanning direction at a front detection point of each of the plurality of recording sheets and at an intermediate detection point of each of the plurality of recording sheets provided backward in the conveying direction at a predetermined interval from the front detection point, the storing unit stores the position of the one edge of each of the plurality of recording sheets in the main scanning direction and the position of the other edge of each of the plurality of recording sheets in the main scanning direction as the at least one edge position, and the at least one predetermined condition further comprises a positional deviation of the plurality of recording sheets being with a predetermined positional deviation range.

16. The ink jet recording apparatus according to claim 1, wherein when the at least one predetermined condition is satisfied, the controller controls the ejection of ink droplets on a predetermined number subsequent recording sheets based at least on the at least one edge position of each of the plurality recording sheets and the at least one characteristic of each of the plurality of the recording sheets.

17. The ink jet recording apparatus according to claim 1, wherein when the at least one predetermined condition is satisfied, the controller controls the ejection of ink droplets on a predetermined number subsequent recording sheets based at least on the at least one edge position of each of the plurality recording sheets and the at least one characteristic of each of the plurality of the recording sheets, and after a last recording sheet of the predetermined number of subsequent recording sheets is conveyed, the detector detects the at least one edge position of a next recording sheet which sequentially is conveyed after the last recording sheet of the predetermined number of subsequent recording sheets, the determining unit determines the at least one characteristic of the last recording sheet, and the controller controls the ejection of ink droplets on the next recording sheet based on the at least one characteristic of the last recording sheet and the at least one edge position of the last recording sheet.

18. The ink jet recording apparatus according to claim 6, wherein the detector detects the position of one edge of each of the plurality of recording sheets in the main scanning direction, the position of the other edge of each of the plurality of recording sheets in the main scanning direction at a front detection point of each of the plurality of recording sheets and at an intermediate detection point of each of the plurality of recording sheets provided backward in the conveying direction at a predetermined interval from the front detection point, and a skew feed amount of each of the plurality of recording sheets at a front detection point of each of the plurality of recording sheets and at an intermediate detection point of each of the plurality of recording sheets provided backward in the conveying direction at a predetermined interval from the front detection point, the storing unit is further configured to store the skew feed amount of each of the plurality of recording sheets, the storing unit stores the position of the one edge of each of the plurality of recording sheets in the main scanning direction and the position of the other edge of each of the plurality of recording sheets in the main scanning direction as the at least one edge position, and the at least one predetermined condition further comprises the skew feed amount of the plurality of recording sheets being with a predetermined skew feed amount range.

19. The ink jet recording apparatus according to claim 7, wherein the detector detects the position of one edge of each of the plurality of recording sheets in the main scanning direction, the position of the other edge of each of the plurality of recording sheets in the main scanning direction at a front detection point of each of the plurality of recording sheets and at an intermediate detection point of each of the plurality of recording sheets provided backward in the conveying direction at a predetermined interval from the front detection point, and a skew feed amount of each of the plurality of recording sheets at a front detection point of each of the plurality of recording sheets and at an intermediate detection point of each of the plurality of recording sheets provided backward in the conveying direction at a predetermined interval from the front detection point, the storing unit is further configured to store the skew feed amount of each of the plurality of recording sheets, the storing unit stores the position of the one edge of each of the plurality of recording sheets in the main scanning direction and the position of the other edge of each of the plurality of recording sheets in the main scanning direction as the at least one edge position, and the at least one predetermined condition further comprises the skew feed amount of the plurality of recording sheets being with a predetermined skew feed amount range.

* * * * *